US005632331A

United States Patent [19]

Shinmura

[11] Patent Number: 5,632,331

[45] Date of Patent: May 27, 1997

[54] HEAT EXCHANGER

[75] Inventor: Toshiharu Shinmura, Sawa-gun, Japan

[73] Assignee: Sanden Corporation, Gunma, Japan

[21] Appl. No.: 305,783

[22] Filed: Sep. 14, 1994

[30] Foreign Application Priority Data

Sep. 30, 1993 [JP] Japan ..... 5-245687

[51] Int. Cl.[6] ..... F28D 1/03

[52] U.S. Cl. ..... 165/153; 165/176

[58] Field of Search ..... 165/153, 167, 165/176, 148, 170

[56] References Cited

U.S. PATENT DOCUMENTS

| | | | |
|---|---|---|---|
| 1,072,512 | 9/1913 | Schewczik | 165/170 X |
| 1,191,681 | 7/1916 | Feldkamp | 165/148 |
| 3,308,879 | 3/1967 | Maddocks | 165/167 |
| 3,435,894 | 4/1969 | Maddocks | 165/167 |
| 3,710,473 | 1/1973 | McElwain et al. . | |
| 3,746,525 | 7/1973 | Kasuga et al. . | |
| 3,757,855 | 9/1973 | Kun et al. | 165/166 |
| 4,663,812 | 5/1987 | Clausen . | |
| 4,749,033 | 6/1988 | Clausen . | |
| 4,974,670 | 12/1990 | Noguchi | 165/153 |
| 5,111,878 | 5/1992 | Kadle . | |
| 5,211,222 | 5/1993 | Shinmura | 165/176 |
| 5,271,151 | 12/1993 | Wallis . | |
| 5,318,114 | 6/1994 | Sasaki | 165/176 |
| 5,439,050 | 8/1995 | Waterman et al. | 165/170 |

FOREIGN PATENT DOCUMENTS

| | | | |
|---|---|---|---|
| 372742 | 4/1907 | France | 165/148 |
| 2010517 | 2/1970 | France . | |
| 2706003 | 8/1977 | Germany | 165/167 |
| 3803599 | 8/1989 | Germany . | |
| 46995 | 4/1981 | Japan . | |
| 122493 | 6/1986 | Japan | 165/166 |
| 73095 | 4/1987 | Japan | 165/153 |
| 153685 | 7/1987 | Japan . | |
| 2165832 | 6/1990 | Japan . | |
| 221789 | 9/1991 | Japan | 165/153 |
| 20794 | 1/1992 | Japan . | |
| 19785 | 1/1995 | Japan . | |
| 1636680 | 3/1991 | U.S.S.R. | 165/166 |
| 1062529 | 3/1967 | United Kingdom | 165/167 |

*Primary Examiner*—Leonard R. Leo
*Attorney, Agent, or Firm*—Baker & Botts, L.L.P.

[57] ABSTRACT

A laminated type evaporator for an automotive air conditioning refrigerant circuit includes a plurality of tube units having a pair of tray-shaped plates. Each tray shaped plate includes a shallow depression defined therein, a flange extending about the periphery thereof, and wall disposed at an intermediate location therein and extending a portion of the length of each plate to thereby define a left side and a right side to each plate. A first plate in the pair includes a plurality of projections formed in its shallow depression. The second plate in the pair includes a plurality of projections formed in its shallow depression. The plurality of projections in the first and second plates are engaged by, e.g., inserting one into the other, so that the plates are secured against lateral and radial relative movement.

8 Claims, 25 Drawing Sheets

HEAT EXCHANGER

BACKGROUND OF THE INVENTION

1. Field of the Invention

This invention relates generally to heat exchangers for refrigerant circuits and, more particularly, to the heat medium conducting elements which constitute a heat exchanging area of the heat exchangers.

2. Description of the Prior Art

Various types of heat exchangers are known in the prior art. For example, U.S. Pat. No. 5,211,222 to Shinmura discloses a laminated type heat exchanger used for an evaporator of an automotive air conditioning refrigerant circuit, as shown in FIG. 1–3. With reference to FIGS. 1–3, the laminated type evaporator 200' includes a plurality of tube units 201 of aluminum alloy functioning as the heat medium conducting elements, which form a heat exchanging area 200*a* of evaporator 200' together with corrugated fins 20. Each of tube units 201 comprises a pair of tray-shaped plates 202 having a clad construction where a brazing metal sheet is formed on a core metal.

As illustrated in FIGS. 2 and 3, each of tray-shaped plates 202 includes a shallow depression 120 defined therein, a flange 13 formed around the periphery thereof, and a narrow wall 14 formed in the central region thereof. Narrow wall 14 extends downwardly from an upper end of plate 202 and terminates approximately one-seventh the length of plate 202 away from the lower end thereof. Narrow wall 14 includes a flat top surface 14*a*. A plurality of diagonally disposed semicylindrical projections 15 project from the inner bottom surface of shallow depression 120. Semicylindrical projections 15 are aligned with one another in each of a plurality of, for example, four rows. There are two rows of semicylindrical projections 15 located in shallow depression 120 on the right side of narrow wall 14 and two rows located on the left side thereof. Semicylindrical projections 15 include a ridge 15*a* and are utilized in order to reinforce the mechanical strength of plate 202.

Each of tray-shaped plates 202 includes a pair of tapered connecting tongues 203 projecting upwardly from the upper end thereof. One of the tongues 203 is disposed to the right of narrow wall 14, and the other tongue 203 is disposed to the left thereof. A depression 203*a* is formed in the central region of tongue 203, longitudinally extends from the upper end to the lower end thereof, and is linked to shallow depression 120 of plate 202. The bottom surface of depression 203*a* is formed even with the plane of the inner bottom surface of shallow depression 120. A pair of diagonally disposed semicylindrical projections 204 are formed on the bottom surface of depression 203*a*. Semicylindrical projections 204 also include a ridge 204*a* and are utilized in order to reinforce the mechanical strength of tongues 203. Semicylindrical projections 204 are longitudinally aligned with each other and are offset from the two rows of semicylindrical projections 15 formed on the inner bottom surface of shallow depression 120.

The edges of flat top surface 14*a* of narrow wall 14, the flat top end surface of each of tongues 203, ridge 15*a* of semicylindrical projections 15 and ridge 204*a* of semicylindrical projections 204 are even with the plane of flange 13. Therefore, when the pair of tray-shaped plates 202 are joined together by flanges 13 so as to form a U-shaped passage 205 therebetween, the pair of tongues 203 of the pair of plates 202 define a pair of tapered hollow connecting portions 203*b*, narrow walls 14 of each plate 202 contact one another at the flat top surfaces 14*a*, semicylindrical projections 15 of plates 202 contact one another at ridges 15*a*, and semicylindrical projections 204 of tongues 203 contact one another at ridges 204*a*. Flanges 13 of plates 202, the flat top end surface of each of tongues 203, the flat top surfaces 14*a* of narrow walls 14 in plates 202, semicylindrical projections 15 of plates 202 and semicylindrical projections 204 of tongues 203 are fixedly attached to each other by brazing, or a like manner.

Laminated type evaporator 200' further includes a pair of parallel closed ended cylindrical pipes 230 and 240 situated above the upper surface of laminated tube units 201. As illustrated in FIG. 2, cylindrical pipe 230 is positioned in front of cylindrical pipe 240. A plurality of generally oval-shaped slots 231 are formed along the lower curved surface of cylindrical pipe 230 at equal intervals. A plurality of generally oval-shaped slots 241 are also formed along the lower curved surface of cylindrical pipe 240 at equal intervals. Generally, oval-shaped slots 231 of pipe 230 are aligned with generally oval-shaped slots 241 of pipe 240 so as to receive the pair of tapered hollow connecting portions 203*b* of tube units 201. The pair of tapered hollow connecting portions 203*b* of tube units 201 are inserted into slots 231 and 241 until the lower end portion of connecting portions 203*b* contacts the inner peripheral surface of slots 231 and 241, respectively. The pair of tapered hollow connecting portions 203*b* are fixedly attached to slots 231 and 241, respectively by, for example, brazing.

A pair of circular openings 232 and 233 (FIG. 1) are formed at the left and right ends of cylindrical pipe 230, respectively, on the front curved surface thereof. One end of inlet pipe 50 is fixedly connected to opening 232 of cylindrical pipe 230 and one end of outlet pipe 60 is fixedly connected to opening 233 of cylindrical pipe 230. Inlet pipe 50 is provided with a union joint 50*a* at the other end thereof and outlet pipe 60 is similarly provided with a union joint 60*a* at the other end thereof.

Circular plate 234 is fixedly disposed at an intermediate location within the interior region of cylindrical pipe 230 so as to divide the cylindrical pipe 230 into a left side section 230*a* and a right side section 230*b*, as shown in FIG. 1.

A rectangular flange 18 projects from the lower end of plate 202, and is bent downwardly in a generally right angle at the terminal end thereof. The downwardly bent portion of adjacent flanges 18 are attached to each other so that an intervening space 21 is formed between the adjacent tube units 201.

The heat exchanging area 200*a* of evaporator 200' is formed by laminating together a plurality of tube units 201 and inserting corrugated fins 20 within the intervening spaces 21 between the adjacent tube units 201. A pair of side plates 22 are attached to the left side of plate 202*a* which is located on the far left side of evaporator 200' and the right side of plate 202*b* which is located on the far right side of evaporator 200', respectively, and corrugated fins 20 are disposed between side plate 22 and plate 202*a*, and between side plate 22 and plate 202*b*, respectively. The lower end of side plate 22 includes a rectangular flange 22*a* projecting inwardly and then bent downwardly in a generally right angle at the terminal end thereof. Respective tube units 201, corrugated fins 20, and side plates 22 are fixedly attached to one another by any conventional manner, such as brazing, for example. Although corrugated fins 20 are only illustrated in FIG. 1 at the upper and lower ends of intervening spaces 21, it should be understood that corrugated fins 20 continually extend along the entire length of intervening spaces 21.

In the above-constructed evaporator 200', when the automotive air conditioning refrigerant circuit operates, the refrigerant flows from a condenser (not shown) of the refrigerant circuit via a throttling device, such as an expansion valve, through inlet pipe 50 into left side section 230*a* of the interior region of cylindrical pipe 230, and through left side section 230*a* in a left to right direction. The refrigerant flowing through left side section 230*a* of the interior region of pipe 230 concurrently flows through the interior region of tapered hollow connecting portions 203*b* and into the upper right region of U-shaped passage 205 in each of tube units 201. The refrigerant in the upper right region of U-shaped passage 205 then flows downwardly to the lower right region of passageway U-shaped 205 in a complex flow path, which includes diagonal and straight flow paths as shown by the solid arrows in FIG. 3, while also exchanging heat with the air passing along corrugated fins 20. The refrigerant located in the lower right region of U-shaped passage 205 is turned at the terminal end of narrow wall 14 and directed from the right side to the left side of U-shaped passage 205, as shown by the solid arrows in FIG. 3. That is, the refrigerant flows from the front to the rear of U-shaped passage 205, then flows upwardly to the upper left region of U-shaped passage 205 in a complex flow path while further exchanging heat with the air passing along corrugated fins 20, and then finally flows out of U-shaped passage 205 in each of tube units 201 through tapered hollow connecting portion 203*b*. The refrigerant flowing out of U-shaped passage 205 from each of tube units 201 combines in the interior region of cylindrical pipe 240 and flows therethrough in a direction from the left side to the right side thereof.

The refrigerant flowing through the interior region of the right side of cylindrical pipe 240 concurrently flows into the upper left region of U-shaped passage 205 in each of tube units 201 through tapered hollow connecting portion 203*b*, and flows downwardly to the lower left region of U-shaped passage 205 in a complex flow path and exchanges heat with the air passing along corrugated fins 20. The refrigerant located in the lower left region of U-shaped passage 205 is turned at the terminal end of narrow wall 14 and directed from the left side to the right side of U-shaped passage 205. That is, the refrigerant flows from the rear to the front of U-shaped passage 205, then flows upwardly to the upper right region of U-shaped passage 205 in a complex flow path while further exchanging heat with the air passing along corrugated fins 20, and finally flows out of U-shaped passage 205 from each of tube units 201 through tapered hollow connecting portions 203*b*. The refrigerant flowing from U-shaped passage 205 in each of tube units 201 combines in the right side section 230*b* of the interior region of cylindrical pipe 230 and flows therethrough in a direction from the left side to the right side thereof. The gaseous phase refrigerant located in the far right side of right side section 230*b* in the interior of cylindrical pipe 230 flows through outlet pipe 60 to the suction chamber of a compressor (not shown) in the refrigerant circuit.

In the manufacturing process of evaporator 200', pairs of plates 202 are fixedly joined to each other by means of brazing the mating surfaces, e.g., the plane of flanges 13, the flat top end surfaces of tongues 203, the flat top surfaces 14*a* of narrow walls 14, the intersecting points of ridges 15*a* of semicylindrical projections 15 and the intersecting points of ridges 204*a* of semicylindrical projections 204, to one another, in general, in an inert gas, such as a helium gas atmosphere. In general, before the pair of plates 202 are fixedly joined to each other by brazing, aluminum oxide formed on the surfaces to be mated must be removed in order to effectively and sufficiently braze the pair of plates 202. For example, the surfaces to be mated are treated with flux so as to remove the aluminum oxide formed thereon.

According to one method of treating the pair of plates 202 with flux, the flux is dissolved in the water and sprayed on the mating surfaces of the pair of plates 202. However, in this treatment method, the flux solution cannot be selectively sprayed only on the mating surfaces. Rather, the flux solution is additionally sprayed on the other, nonmating portions of the pair of plates 202, such as, the inner bottom surface of shallow depression 120 and the bottom surface of depression 203*a*. Consequently, residual flux remains on the inner bottom surface of shallow depression 120 and the bottom surface of depression 203*a* after the pair of plates 202 are brazed to one another.

The residual flux has been observed to peel off throughout the life of the heat exchanger. The flakes of residual flux then circulate through the refrigerant circuit during operation of the automotive air conditioning system. The circulating flakes of residual flux flowing through the refrigerant circuit may choke the refrigerant flow path of the refrigerant circuit so that the automotive air conditioning system may be seriously damaged and/or the heat exchange efficiency is impaired.

In order to avoid the above-mentioned defect, a "vacuum brazing process", where the elements of the evaporator are brazed in a vacuum, has been proposed. However, the vacuum brazing process requires a relatively large space for the vacuum pump, and elaborate and frequent maintenance for assuring the appropriate amount of vacuum in the brazing furnace.

These and other disadvantages of the prior art are addressed by the heat exchanger of the preferred embodiments.

SUMMARY OF THE INVENTION

Accordingly, it is an object of the present invention to provide a heat exchanger which can be easily manufactured without creating residual flux in the heat medium flow path of the heat exchanger.

In order to obtain the above and other objects, a heat exchanger is provided including a plurality of tube units having a pair of tray-shaped plates. Each tray shaped plate includes a shallow depression defined therein, a flange extending about the periphery thereof, and wall disposed at an intermediate location therein and extending a portion of the length of each plate to thereby define a left side and a right side to each plate. A first plate in the pair includes a plurality of projections formed in its shallow depression. The second plate in the pair includes a plurality of projections formed in its shallow depression. The plurality of projections in the first and second plates are engaged by, e.g., inserting one into the other, so that the plates are secured against lateral and radial relative movement.

After the first and second plates are assembled together, they can be sprayed from the outside with a flux and water solution. The solution seeps into gaps formed between the mating surfaces of the plurality of projections and the mating surfaces of the flanges. Accordingly, the manufacture of the heat exchanger substantially avoids the undesirable circulation of flux flakes inside of the refrigerant circuit.

DETAILED DESCRIPTION OF THE PREFERRED EMBODIMENTS

Figure 1:
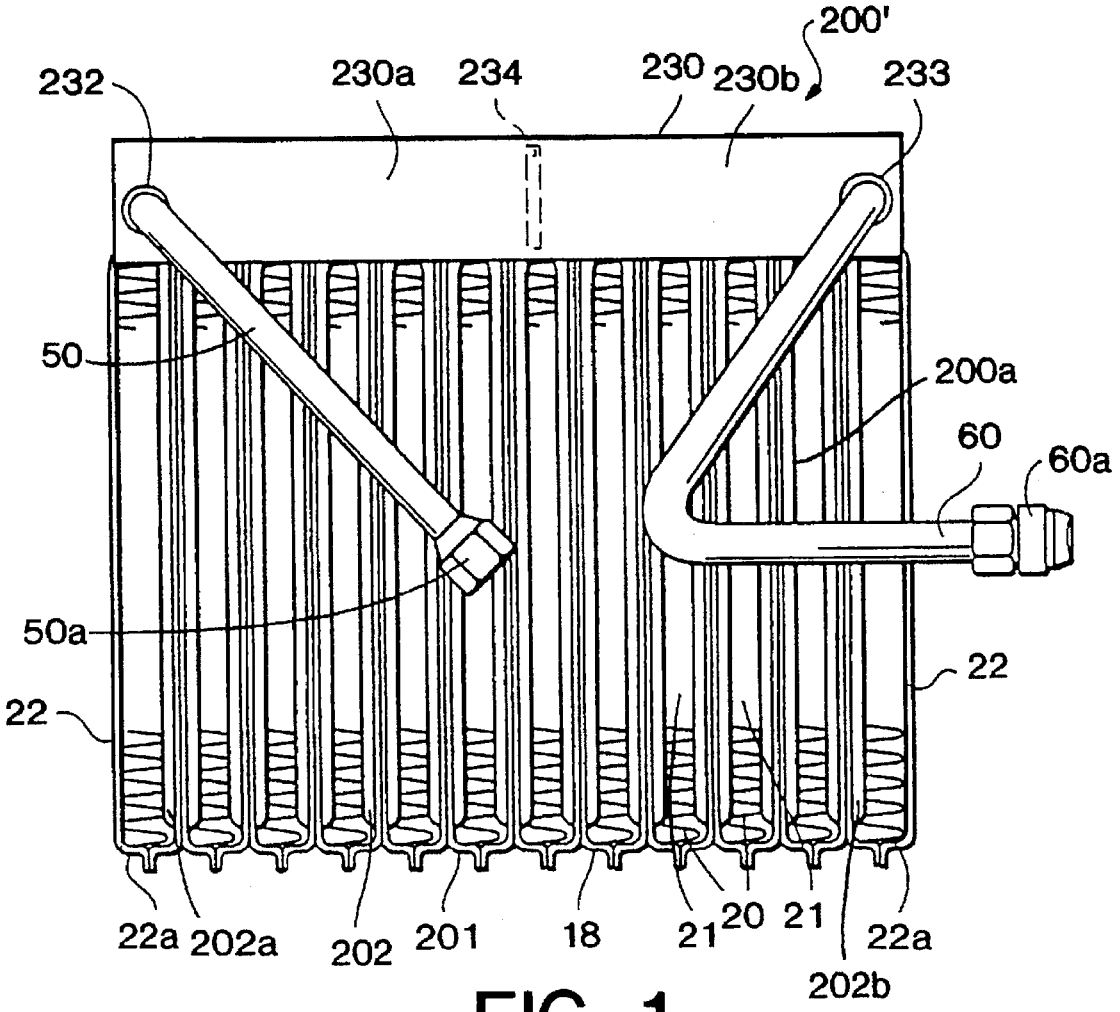
FIG. 1 (PRIOR ART)
FIG. 1 is an elevational front view of a laminated type evaporator in accordance with the prior art.
Figure 2:
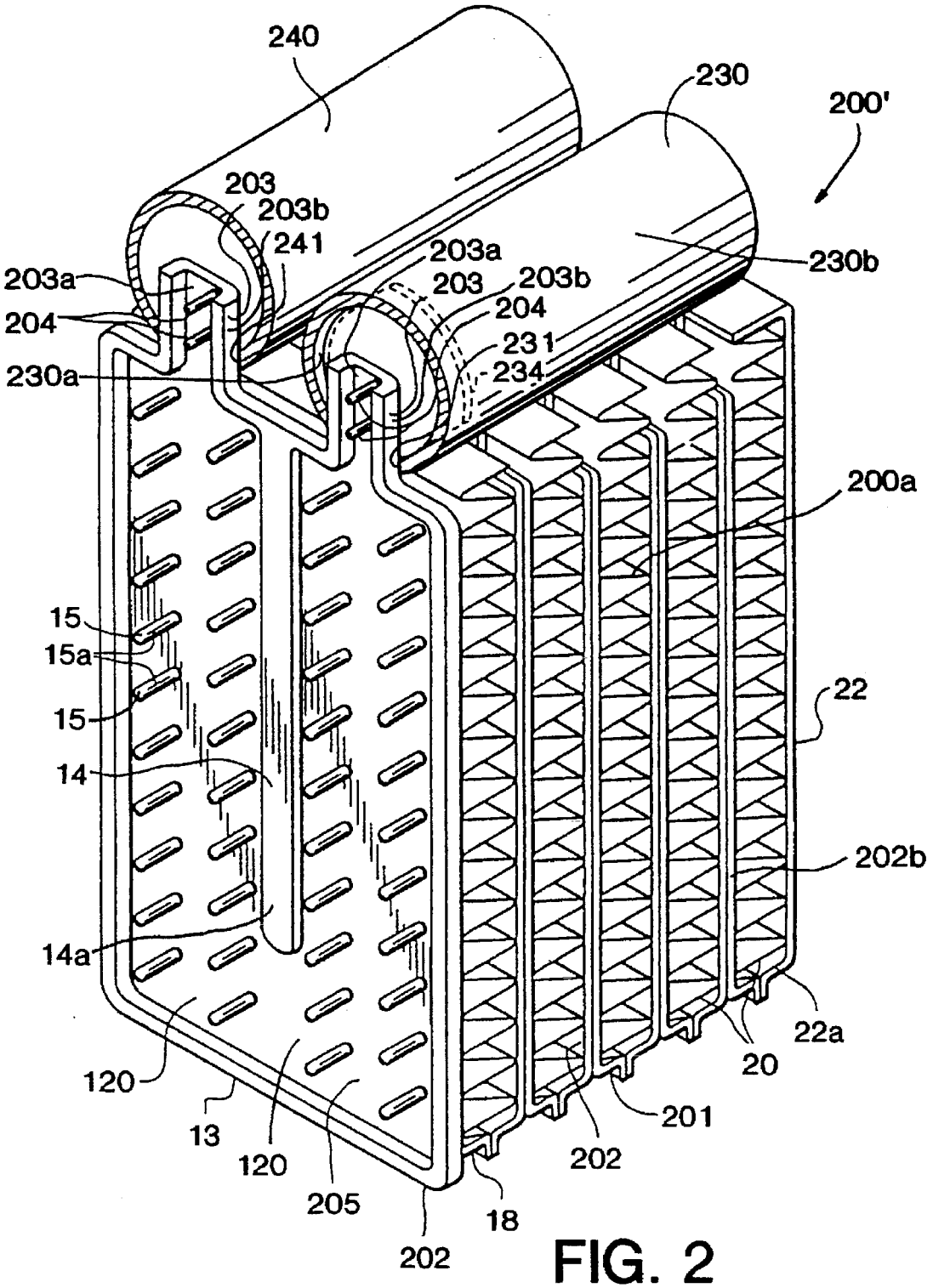
FIG. 2 (PRIOR ART)
FIG. 2 is a perspective cut-away view of the laminated type evaporator shown in FIG. 1.
Figure 3:
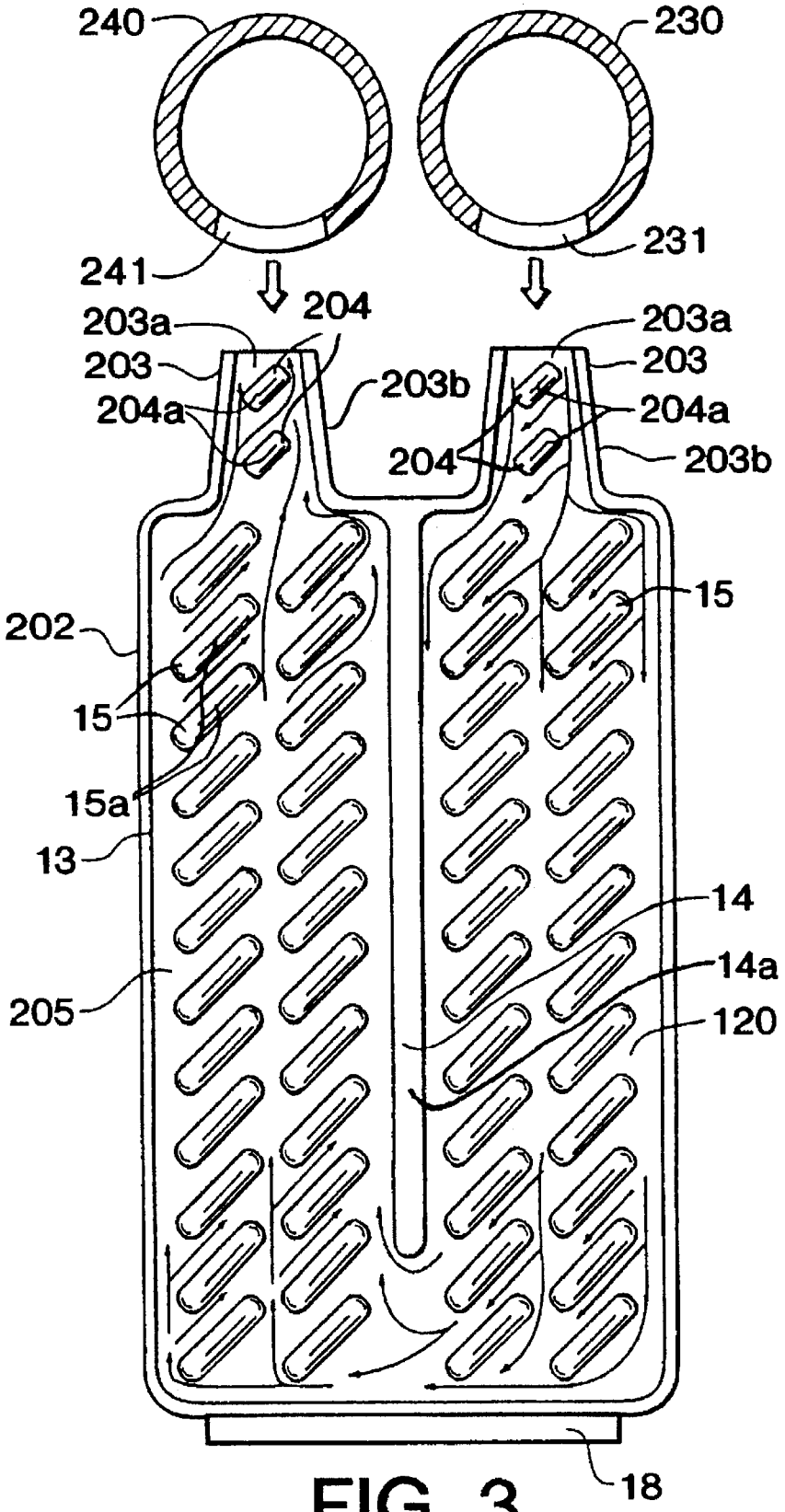
FIG. 3 (PRIOR ART)
FIG. 3 is an exploded side view of the evaporator shown in FIG. 2.

FIGS. 4–10 illustrate a first preferred embodiment. In the drawings, like reference numerals are used to denote elements corresponding to those shown in FIGS. 1–3, and a detailed explanation thereof is therefore omitted.

Figure 4:
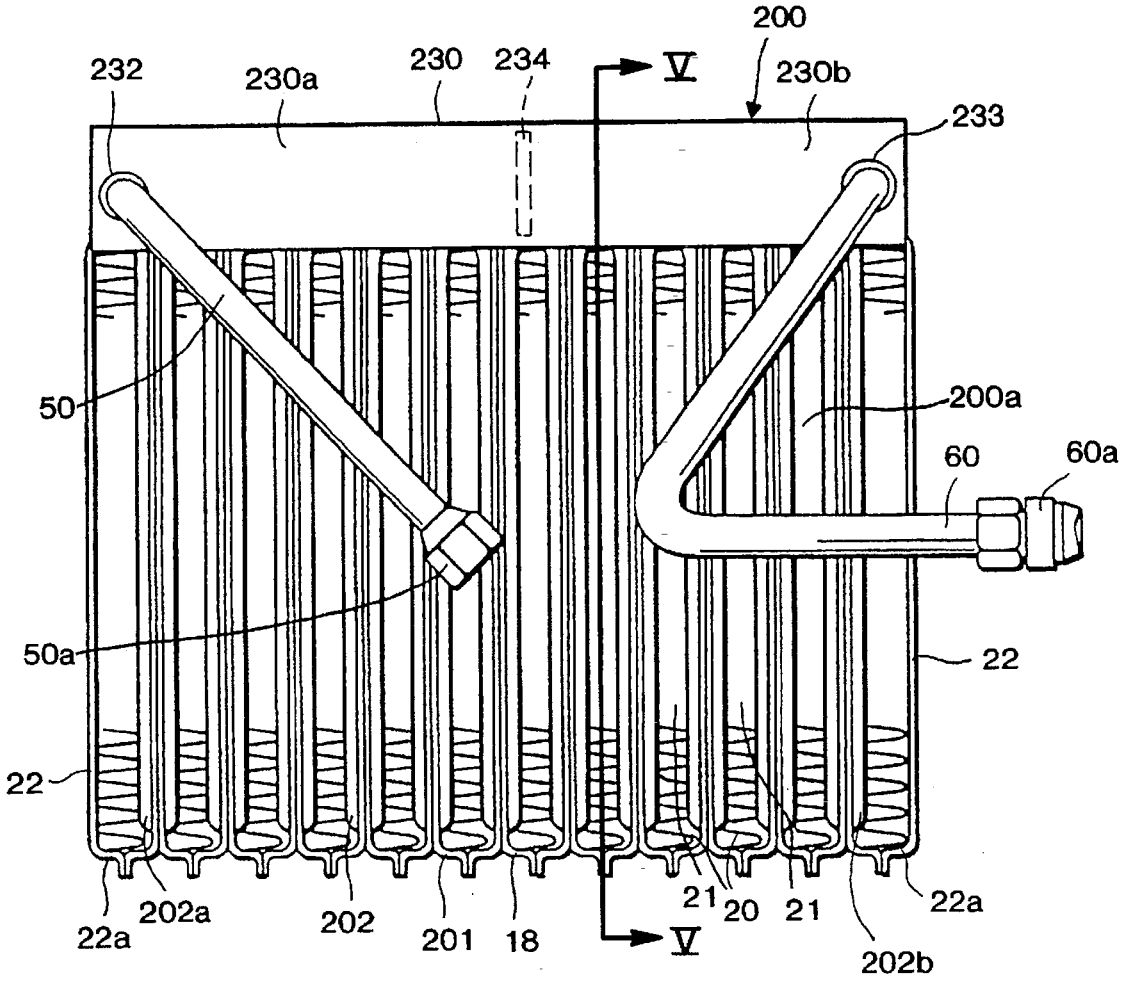
FIG. 4 is an elevational front view of a laminated type evaporator in accordance with a first preferred embodiment.
Figure 5:
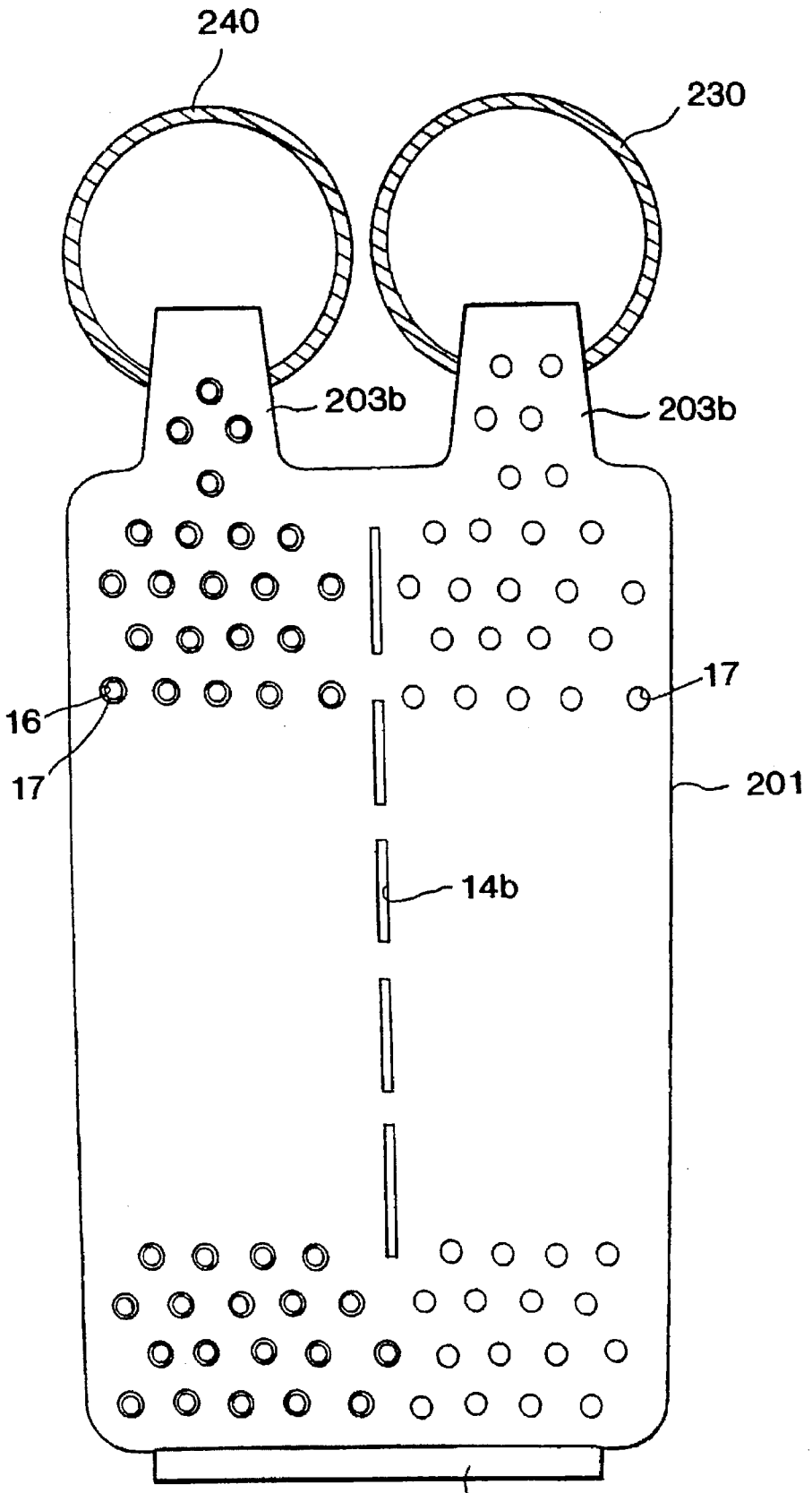
FIG. 5 is an end view of an assembled tube unit taken on line V—V in FIG. 4.

With reference to FIG. 4, the laminated type evaporator 200 includes a plurality of tube units 201 of aluminum alloy functioning as the heat medium conducting elements, which form a heat exchanging area 200*a* of evaporator 200 together with the corrugated fins 20. Each of tube units 201 comprises a pair of tray-shaped plates 202 having a clad construction where a brazing metal sheet is formed on a core metal.

Figure 6B:
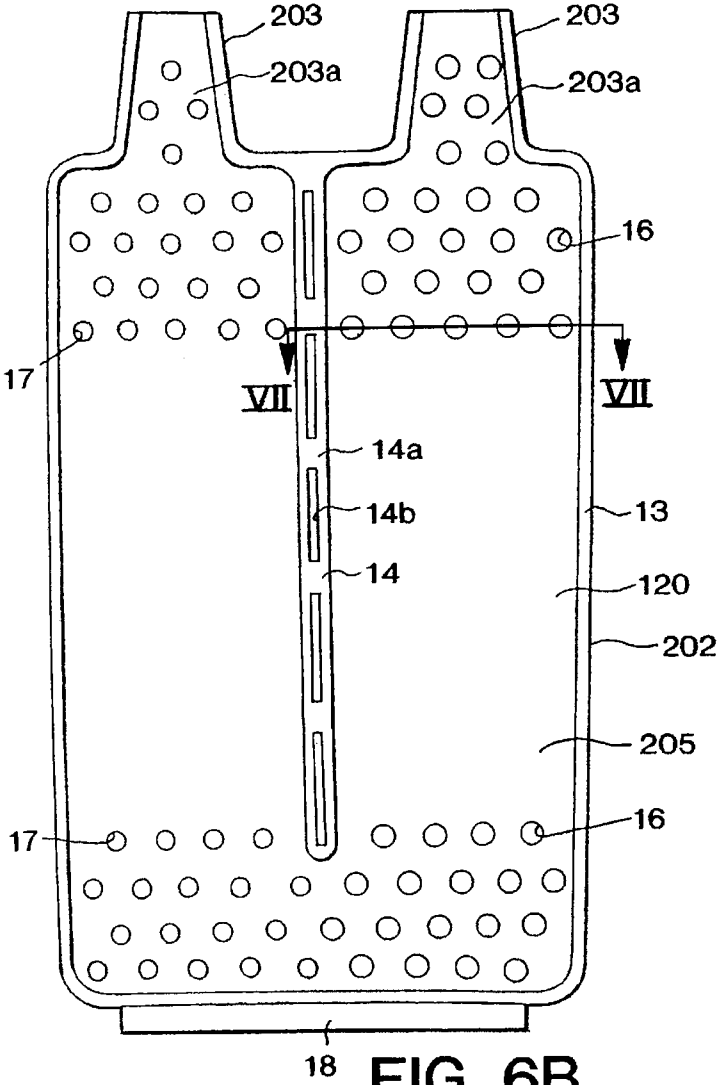
FIG. 6 shows the tube unit in FIG. 5 unassembled.
Figure 6A:
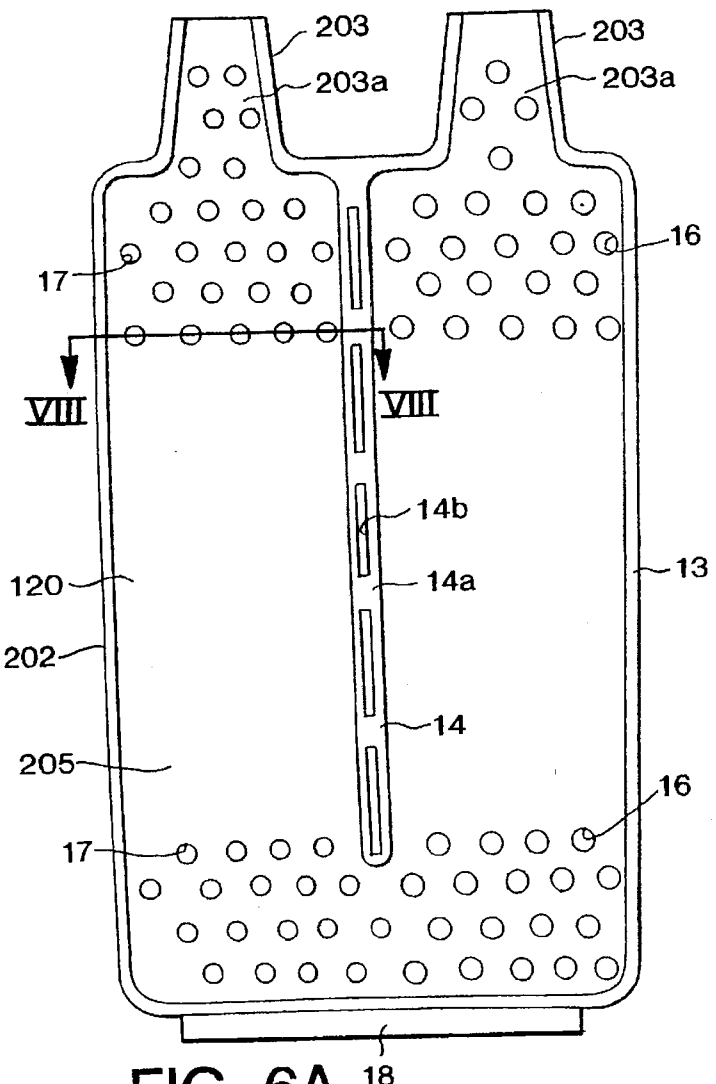

With particular reference to FIG. 6, a plurality of annular cylindrical projections 16 and 17 project from the inner bottom surface of shallow depression 120 and the bottom surface of depression 203*a*. Annular cylindrical projections 16 and 17 are formed by, for example, burring. Annular cylindrical projections 16 are located in shallow depression 120 and depression 203*a* on the right side of narrow wall 14 and annular cylindrical projections 17 are located on the left side thereof. Annular cylindrical projections 16 are laterally aligned with one another at regular intervals in a plurality of rows. The rows of annular cylindrical projections 16 are arranged at regular intervals, but the adjacent rows of annular cylindrical projections 16 are relatively offset at one half of the length of the interval of projections 16. In another point of view, annular cylindrical projections 16 are arranged diagonally at regular intervals in a plurality of rows.

The arrangement of annular cylindrical projections 17 is similar to that of annular cylindrical projections 16. The arrangement of annular cylindrical projections 16 and 17 in one of the pair of plates 202 is identical to that in the other of the pair of plates 202 so that the pair of plates 202 can be joined.

Figure 7:
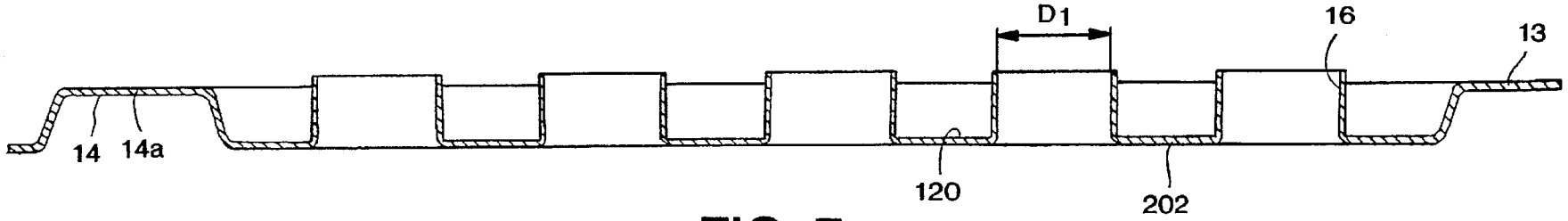
FIG. 7 is a view taken on line VII—VII of FIG. 6.
Figure 8:
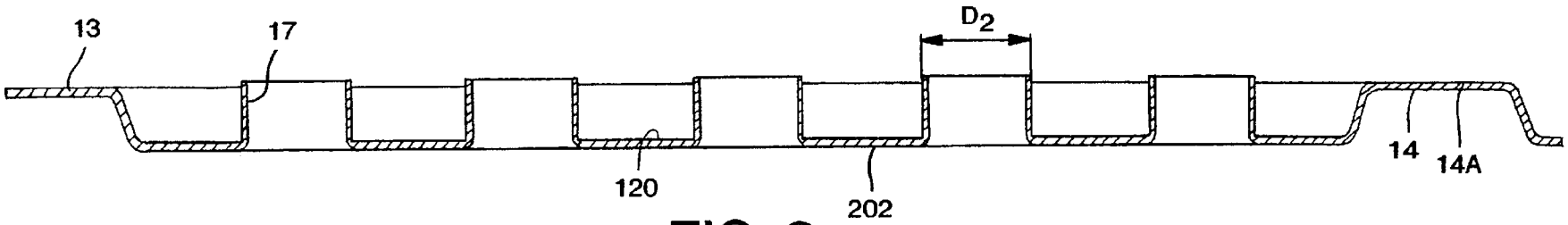
FIG. 8 is a view taken on line VIII—VIII of FIG. 6.

Although annular cylindrical projections 16 and 17 are not illustrated in the central region of shallow depression 120 in FIG. 6, it should be understood that annular cylindrical projections 16 and 17 continually extend along the entire length of shallow depression 120. As best seen in FIGS. 7 and 8, an inner diameter D1 of annular cylindrical projection 16 is slightly greater than an outer diameter D2 of annular cylindrical projections 17. In addition, a top end surface of each of annular cylindrical projections 16 and 17 slightly extends over the flat top surface 14*a* of narrow wall 14, the flat top end surface of each of tongues 203 and the plane of flange 13. A plurality of, for example, five rectangular-shaped openings 14*b* (FIG. 6) are formed at the flat top surface 14*a* of narrow wall 14 along the entire length of narrow wall 14.

Figure 9:
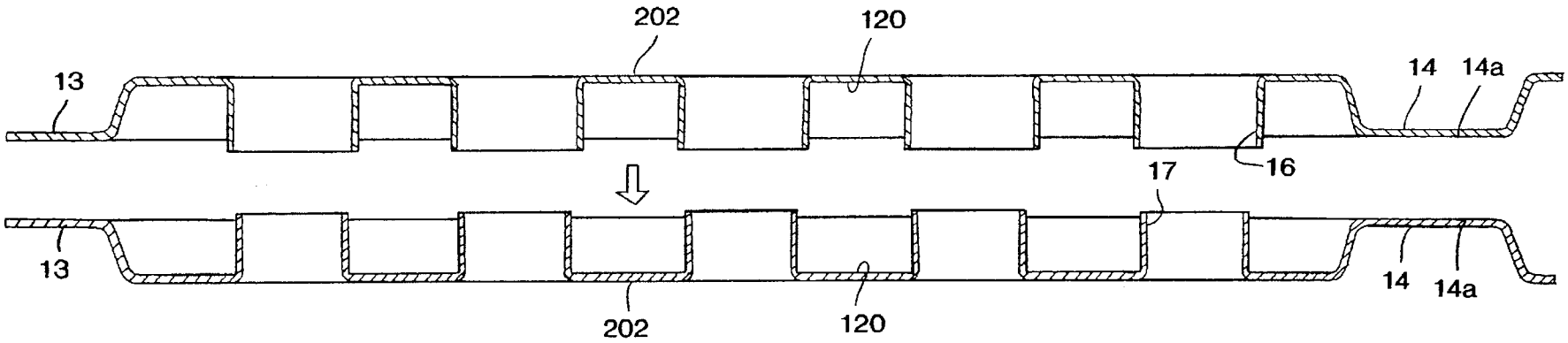
FIGS. 9 and 10 illustrate when the pair of plates of the tube unit shown in FIGS. 8 and 9 are joined to each other.
Figure 10:
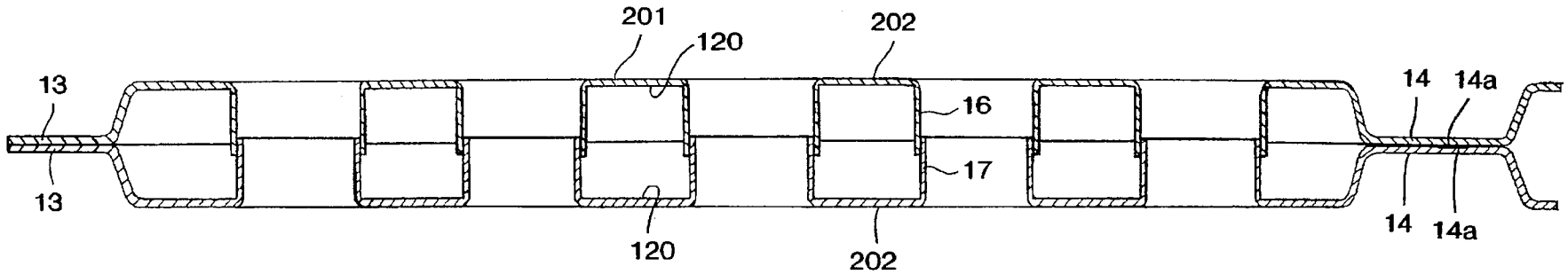

When evaporator 200 is temporarily assembled in a manufacturing process thereof, as shown in FIGS. 9 and 10, the pair of plates 202 are temporarily joined to each other by mating the plane of flanges 13, the flat top end surface of tongues 203 (not shown in FIGS. 9 and 10) and the flat top surfaces 14*a* of narrow walls 14. When the pair of plates 202 are temporarily joined to each other, the top end portion of cylindrical projections 17 is snugly received in the top end portion of the corresponding cylindrical projections 16 as shown in FIG. 10.

After evaporator 200 is temporarily assembled, the elements constituting evaporator 200 are fixedly connected to one another by means of brazing, in general, in an inert gas, such as, a helium gas atmosphere. In this process, the mating surfaces of the pair of plates 202 are brazed to one another so as to fixedly join the pair of plates 202 to each other. Before the mating surfaces of the pair of plates 202 are brazed one another, the surfaces to be mated are treated with flux so as to remove the aluminum oxide formed thereon.

According to the first preferred embodiment, the flux is dissolved in water and sprayed on the entire exterior surface of the temporarily assembled pair of plates 202. Some of the flux solution on the exterior surface of the temporarily assembled pair of plates 202 seeps into the small gaps between the mating surfaces of flanges 13, and the flat top end surfaces of tongues 203. In addition, some of the flux solution on the exterior surface of the temporarily assembled pair of plates 202 also seeps into the small gaps created between the mating surface of narrow walls 14 through rectangular-shaped openings 14*b*.

In addition, the flux solution on the exterior surface of the temporarily joined pair of plates 202 seeps into the small gaps between an inner peripheral surface of the top end portion of cylindrical projections 16 and an outer peripheral surface of the top end portion of the corresponding cylindrical projections 17.

Thus, the flux solution seeps into substantially all of the mating surfaces of the temporarily assembled pair of plates 202. Therefore, substantially all of the entire mating surfaces of the temporarily joined pair of plates 202 to be brazed are sufficiently and effectively treated by the flux so that the aluminum oxide formed thereon is sufficiently removed when the mating surfaces of the pair of plates 202 are brazed to one another.

Furthermore, instead of spraying the flux solution, flux powder may be adsorbed on the entire exterior surface of the temporarily joined pair of plates 202 by electrostatic adsorption. According to this treatment method, the flux powder adsorbed on the exterior surface of the temporarily joined pair of plates 202 is melted before the brazing metal sheet is melted, and then the melted flux seeps into substantially all of the mating surfaces of the temporarily joined pair of plates 202. Therefore, substantially all of the mating surfaces of the temporarily joined pair of plates 202 to be brazed are sufficiently and effectively treated by the flux so that the aluminum oxide formed thereon is sufficiently removed when the mating surfaces of the pair of plates 202 are brazed to one another.

According to this preferred embodiment, since only the exterior surface of the temporarily joined pair of plates 202 is covered with the flux, no residual flux is formed on the inner bottom surface of shallow depression 120 and the bottom surface of depression 203*a*. Therefore, the refrigerant flow path of the automotive air conditioning system is not choked by flakes of residual flux. Moreover, the elimination of residual flux is accomplished without employing the complicated and expensive "vacuum brazing process" discussed above.

Furthermore, since the top end portion of cylindrical projections 16 and the top end portion of the corresponding cylindrical projections 17 are brazed to each other, the mechanical strength of tube units 201 is reinforced. In addition, because annular cylindrical projections 16 and 17 are diagonally aligned with one another in a plurality of rows, the refrigerant fluid flows through U-shaped passage 205 defined in tube units 201 in a complex flow path, which includes diagonal and straight flow paths. Consequently, the heat exchange efficiency of evaporator 200 is enhanced.

FIGS. 11, 12, 13, 14, 15–16, 17–19, 20, 21, 22–24, 25, 26, 27, and 28–31 illustrate the second through fourteenth preferred embodiments, respectively. In the drawings, like reference numerals are used to denote elements corresponding to those shown in FIGS. 1–10 and a detailed explanation thereof is therefore omitted. Furthermore, the function and effect of the second through fourteenth preferred embodiments are generally similar to those of the first preferred embodiment so that a detailed explanation thereof is likewise omitted.

Figure 11B:
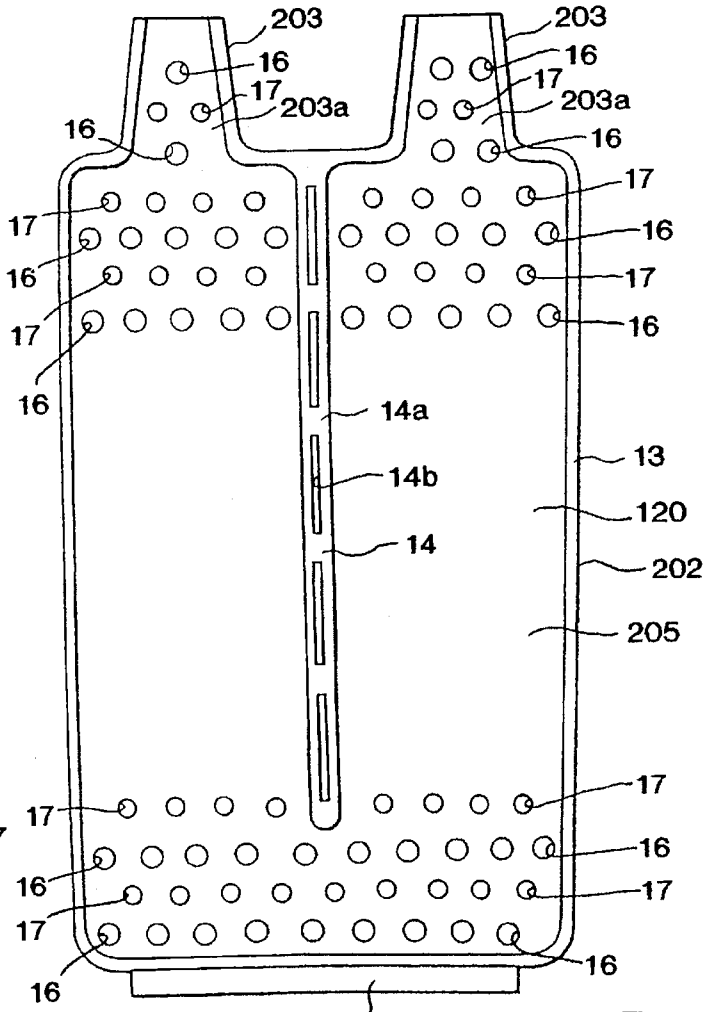
FIG. 11 is a view similar to FIG. 6 showing a second preferred embodiment.
Figure 11A:
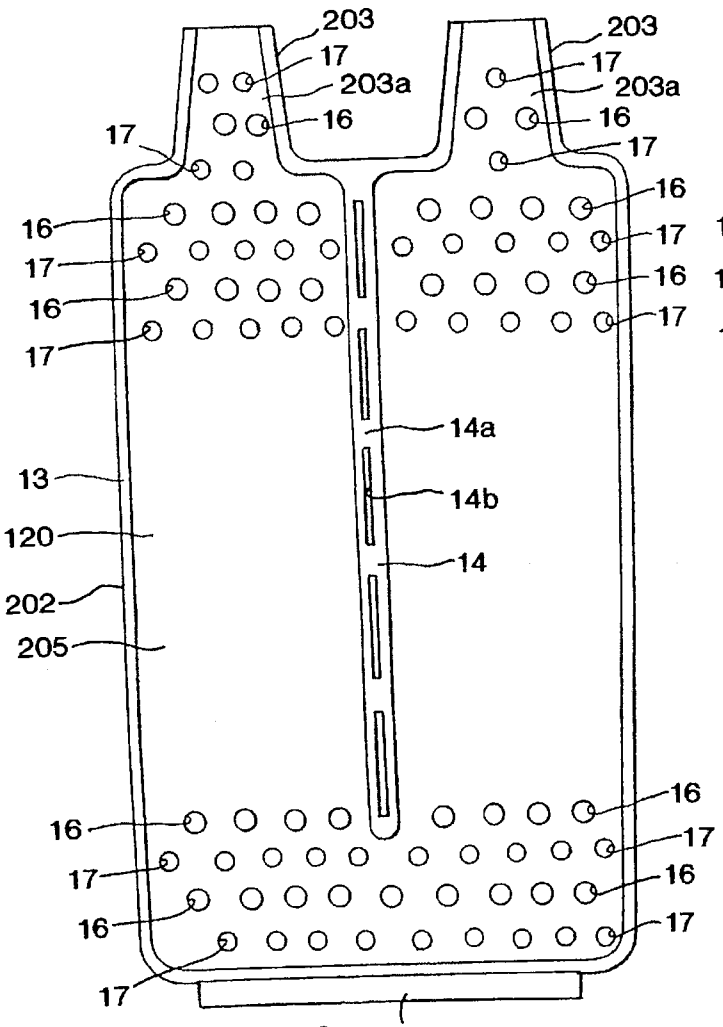

With reference to FIG. 11 illustrating the second preferred embodiment, annular cylindrical projections 16 and 17 are located in shallow depression 120 and depression 203*a* on both of the right and left sides of narrow wall 14. Annular cylindrical projections 16 are laterally aligned with one another at regular intervals in a plurality of rows. Annular cylindrical projections 17 are also laterally aligned with one another at regular intervals in a plurality of rows. The rows of annular cylindrical projections 16 and the rows of annular cylindrical projections 17 are arranged alternately at regular intervals, and are relatively offset at one half of the length of the interval of annular cylindrical projections 16 or 17. In another point of view, annular cylindrical projections 16 and 17 are arranged alternately at regular intervals in a plurality of diagonal rows.

Annular cylindrical projections 16 and 17 in one of the pair of plates 202 are arranged to correspond to annular cylindrical projections 17 and 16 in the other of the pair of plates 202, respectively, so that the pair of plates 202 may be joined to one another.

Figure 12B:
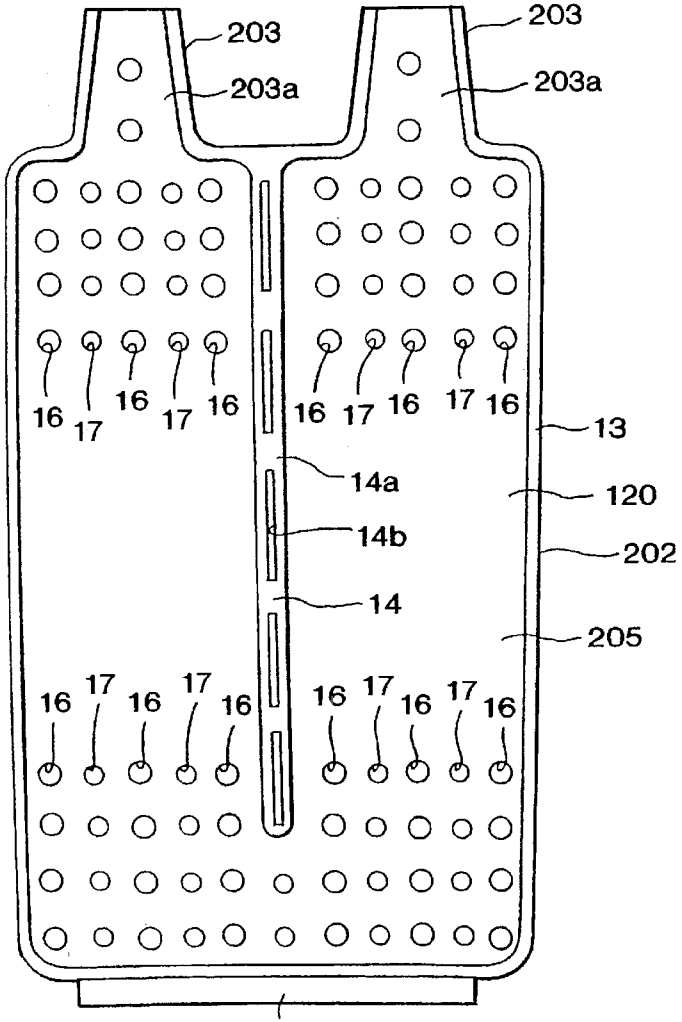
FIG. 12 is a view similar to FIG. 6 showing a third preferred embodiment.
Figure 12A:
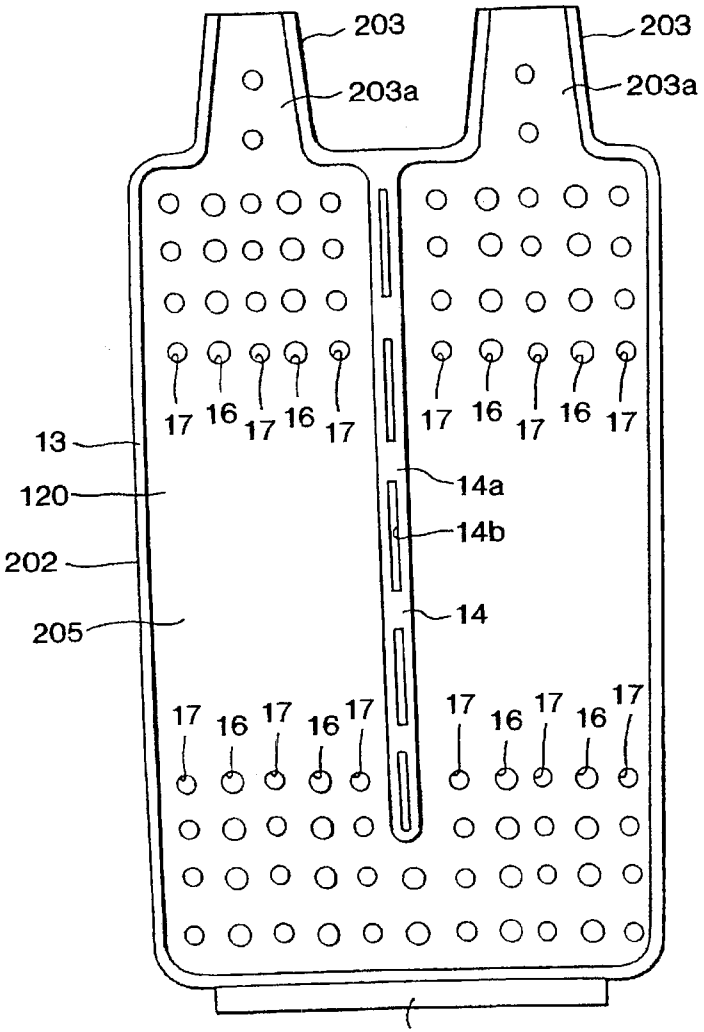

With reference to FIG. 12 illustrating the third preferred embodiment, annular cylindrical projections 16 and 17 are located in shallow depression 120 and depression 203*a* on both of the right and left sides of narrow wall 14. Annular cylindrical projections 16 are longitudinally aligned with one another at regular intervals in a plurality of columns. Annular cylindrical projections 17 are also longitudinally aligned with one another at regular intervals in a plurality of columns. The columns of annular cylindrical projections 16 and the columns of annular cylindrical projections 17 are arranged alternately at regular intervals. The intervals between the columns of annular cylindrical projections 17 is equal to the intervals between the columns of annular cylindrical projections 16. In another point of view, annular cylindrical projections 16 and 17 are arranged alternately at regular intervals in a plurality of diagonal rows.

Annular cylindrical projections 16 and 17 in one of the pair of plates 202 are arranged to correspond to annular cylindrical projections 17 and 16 in the other of the pair of plates 202, respectively, so that the pair of plates 202 may be joined to one another.

Figure 13B:
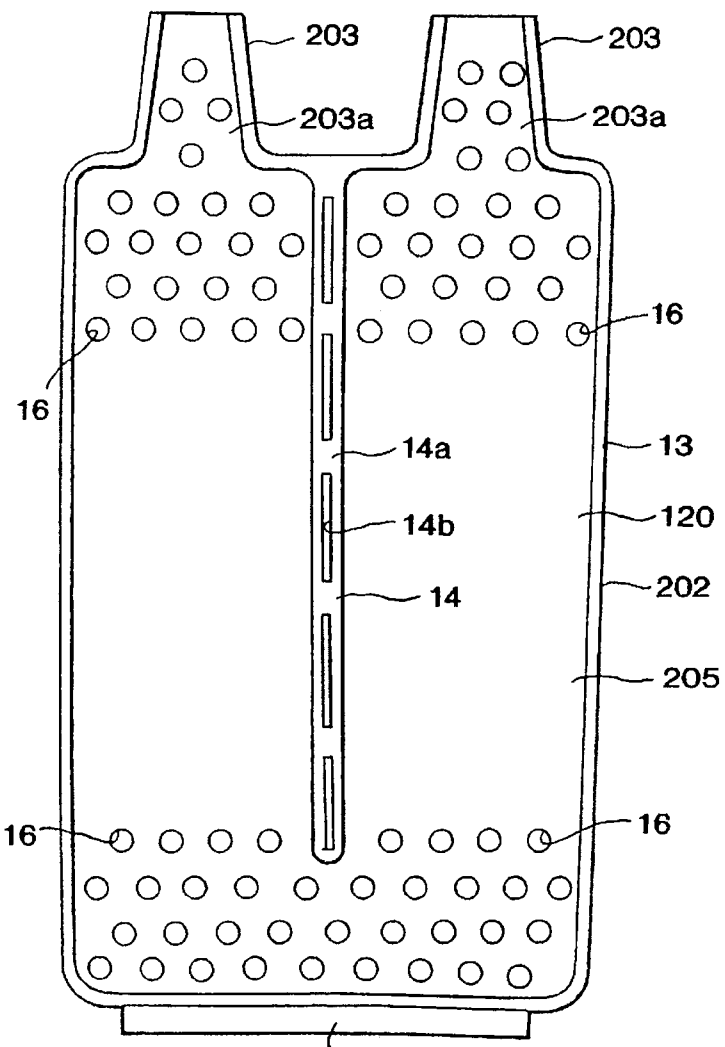
FIG. 13 is a view similar to FIG. 6 showing a fourth preferred embodiment.
Figure 13A:
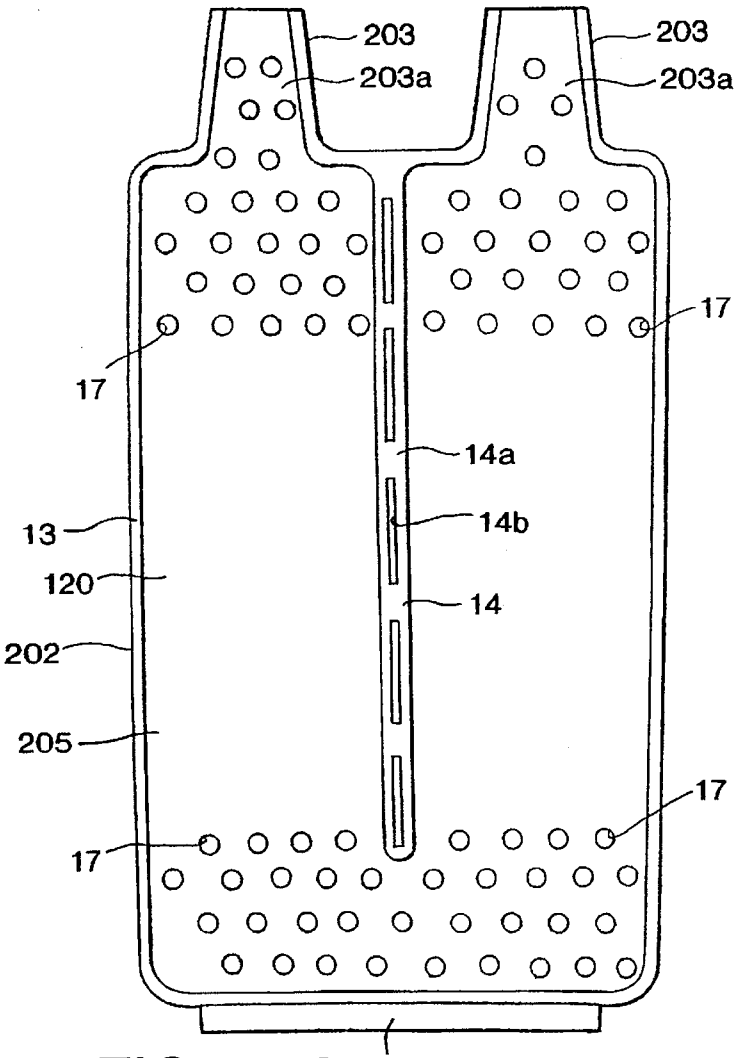

With reference to FIG. 13 illustrating the fourth preferred embodiment, annular cylindrical projections 16 are located in the entire shallow depression 120 and the entire depression 203*a* of one of the pair of plates 202. Annular cylindrical projections 16 are laterally aligned with one another at regular intervals in a plurality of rows. The rows of annular cylindrical projections 16 are arranged at regular intervals, but the adjacent rows of annular cylindrical projections 16 are relatively offset at one half of the length of the interval of projections 16. In another point of view, annular cylindrical projections 16 are arranged at regular intervals in a plurality of diagonal rows.

The arrangement of annular cylindrical projections 17 in the other of the pair of plates 202 is similar to that of annular cylindrical projections 16 in the immediately-described plate 202 so that the pair of plates 202 may be joined to one another.

Figure 14:
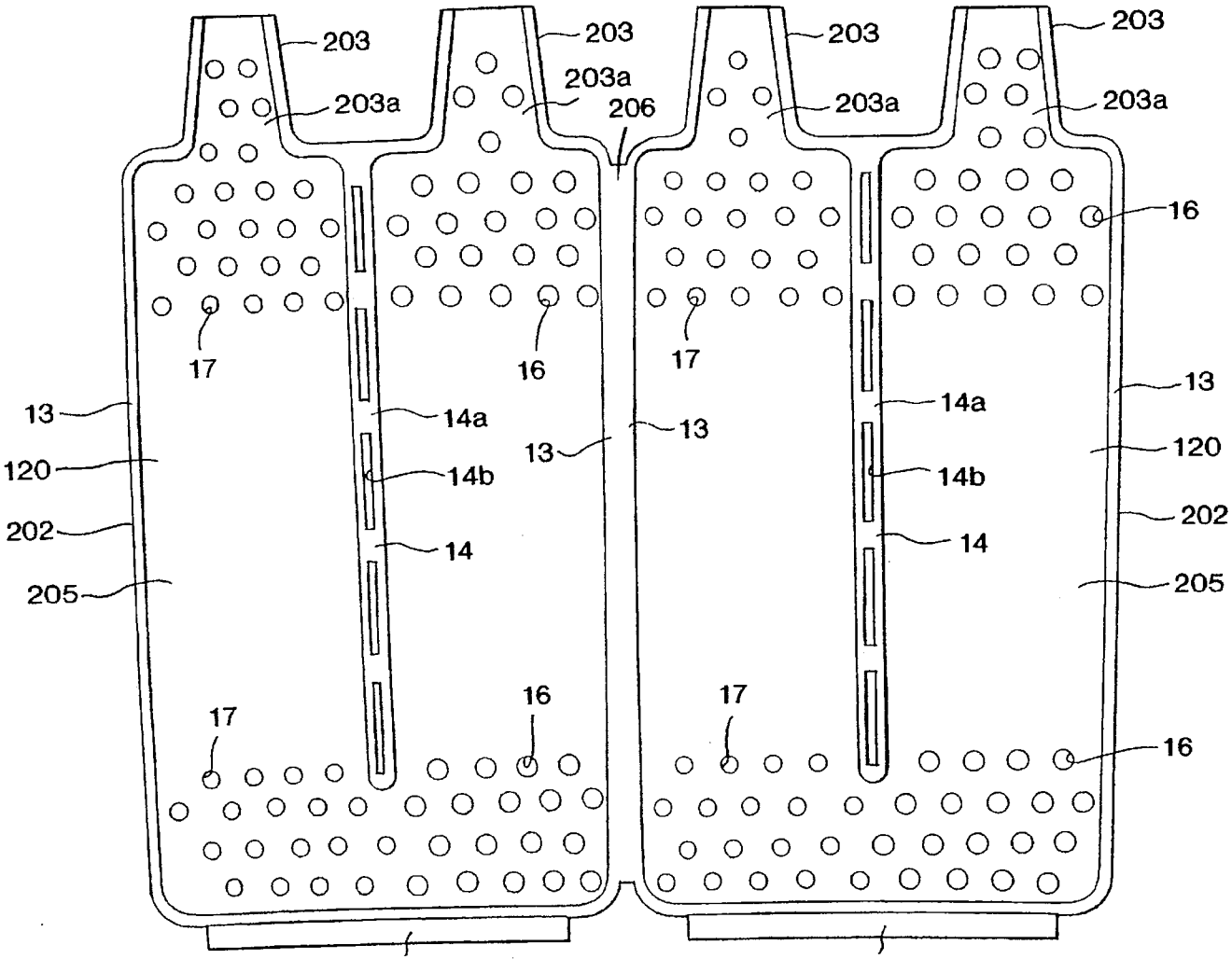
FIG. 14 is a view similar to FIG. 6 showing a fifth preferred embodiment.

With reference to FIG. 14 illustrating a fifth preferred embodiment, the pair of plates 202 are formed integrally through a long and narrow planar portion 206 which extends adjacent longitudinal portions of flanges 13. The surface of planar portion 206 is even with the plane of flanges 13. The pair of plates 202 are joined to each other by folding planar portion 206. In this preferred embodiment, though annular cylindrical projections 16 and 17 are shown as being arranged in the plates 202 in a manner similar to that of the first preferred embodiment, the arrangement of annular cylindrical projections 16 and 17 in the plates 202 is not restricted thereto. Any type of the arrangement of annular cylindrical projections 16 and 17 in the plates 202, such as shown in FIGS. 11–13, can be provided. According to the fifth preferred embodiment, since the pair of plates 202 are joined by folding planar portion 206, relative sliding movement of the pair of plates 202 in the radial direction is effectively prevented after the process of temporarily assembling tube unit 201.

Figure 15:
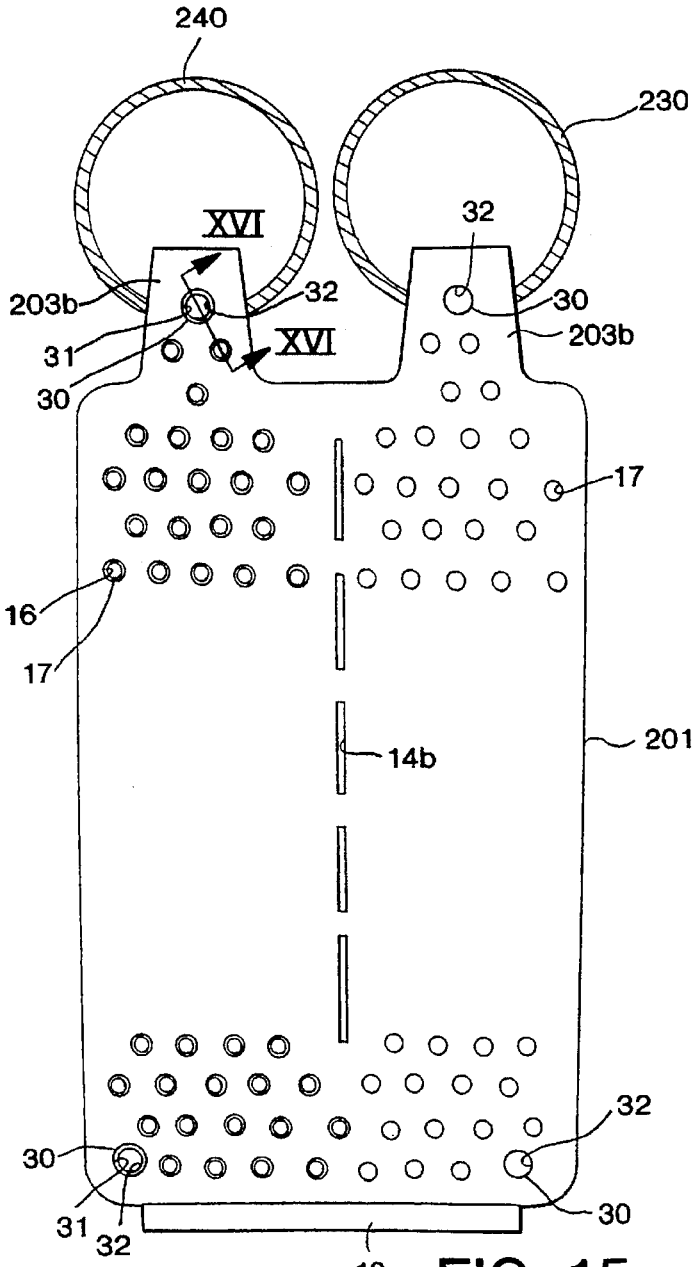
FIG. 15 is a view similar to FIG. 5 showing a sixth preferred embodiment.
Figure 16:
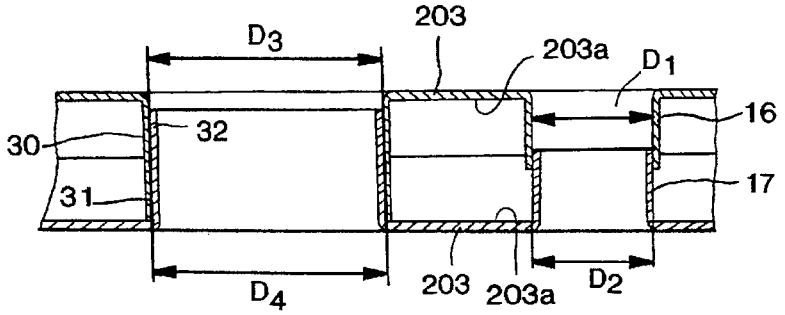
FIG. 16 is a view taken on line XVI—XVI of FIG. 15.

With reference to FIGS. 15 and 16 illustrating a sixth preferred embodiment, each of tube units 201 is provided with a plurality of, e.g., four, engagements 30 of annular cylindrical projections 31 and 32. As shown in FIG. 15, two engagements 30 are provided at the pair of tapered hollow connecting portions 203*b*, respectively, and the other two engagements 30 are provided at the lower left and lower right comers of tube unit 201, respectively.

As shown in FIG. 16, an inner diameter D3 of annular cylindrical projection 31 is generally twice the inner diameter D1 of annular cylindrical projection 16, and an outer diameter D4 of annular cylindrical projection 32 is generally twice the outer diameter D2 of annular cylindrical projection 17. The inner diameter D3 of annular cylindrical projection 31 is slightly greater then the outer diameter D4 of annular cylindrical projection 32. In addition, a top end surface of each of annular cylindrical projections 31 and 32 sufficiently extends over the flat top surface 14*a* of narrow wall 14 (shown in FIG. 7), the flat top end surface of each of tongues 203 (shown in FIG. 6) and the plane of flange 13 (shown in FIG. 7). Thus, annular cylindrical projections 31 and 32 are sufficiently engaged to one another in the axial direction thereof. Therefore, after the process of temporarily assembling tube unit 201, the relative sliding movement of the pair of plates 202 is effectively prevented by the engagements 30 of annular cylindrical projections 31 and 32.

Figure 17:
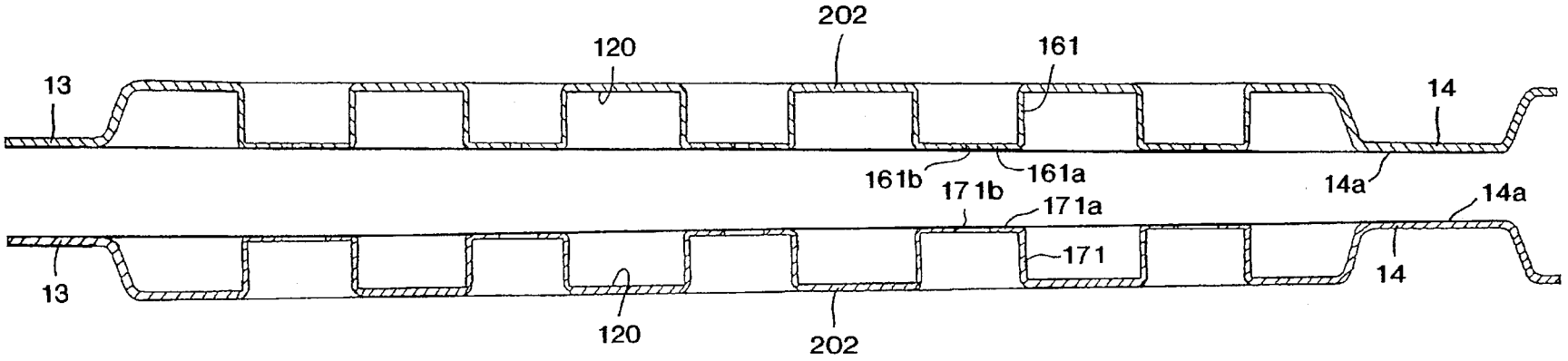
FIGS. 17–19 are views illustrating when a pair of plates of a tube unit in accordance with a seventh preferred embodiment are joined to each other.
Figure 18:
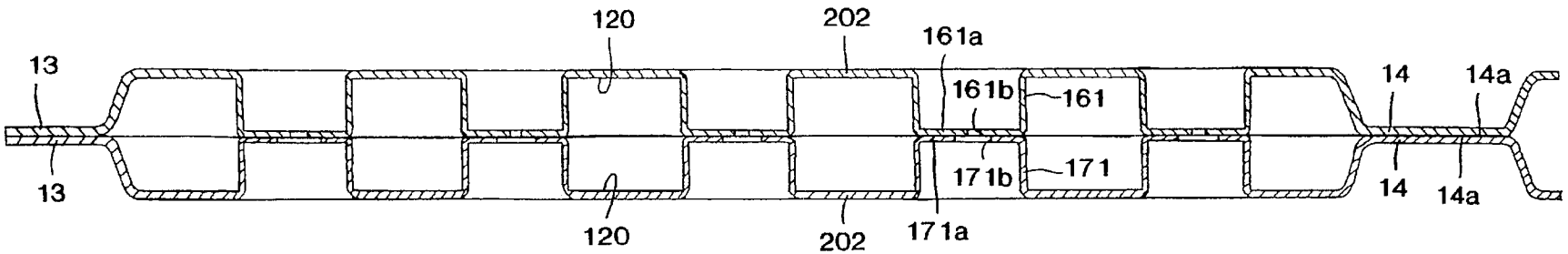
Figure 19:
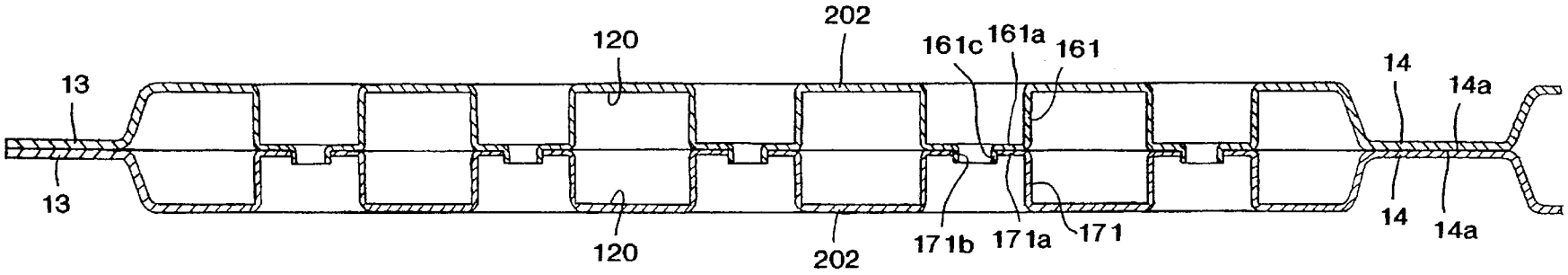

With reference to FIGS. 17–19 illustrating the seventh preferred embodiment, a plurality of cylindrical bulged portions 161 are formed at the inner bottom surface of shallow depression 120. A plurality of cylindrical bulged portions 171 which are identical to cylindrical bulged portions 161 are formed at the inner bottom surface of opposing shallow depression 120 to correspond to cylindrical bulged portions 161 when the pair of plates 202 are joined to each other. Circular opening 161*b* is formed at a central region of a flat bottom end section 161*a* of each of bulged portions 161. Circular opening 171*b* is formed at a central region of a flat bottom end section 171*a* of each of bulged portions 171 as well. The diameter of circular opening 171*b* is approximately three times greater than the diameter of circular opening 161*b*. The plane of the upper surface of the flat bottom end section 161*a* of bulged portions 161 is even with the plane of flange 13, the flat top surface 14*a* of narrow wall 14 and the flat top end surface of tongue 203 (which is illustrated in FIG. 6). The plane of the upper surface of the flat bottom end section 171*a* of bulged portions 171 is even with the plane of flange 13, the flat top surface 14*a* of narrow wall 14 and the flat top end surface of tongue 203 (which is illustrated in FIG. 6) as well.

Thus, as shown in FIG. 18, when the pair of plates 202 are temporarily joined to each other, bulged portions 161 and 171 contact one another at the upper surfaces of their flat bottom end sections 161*a* and 171*a*, flanges 13 contact one another, tongues 203 contact one another at their flat top end surfaces (FIG. 6), and narrow walls 14 contact one another at their flat top surfaces 14*a*. Then, as shown in FIG. 19, an inner peripheral portion of circular opening 161*b* of each bulged portion 161 is bent downwardly to form annular cylindrical projection 161*c*. Annular cylindrical projection 161*c* is snugly fit into circular opening 171*b* of bulged portion 171 so that bulged portions 161 and 171 are firmly engaged with one another.

According to the seventh preferred embodiment, due to the firm engagement of bulged portions 161 and 171, the relative sliding movement of the pair of plates 202 in the radial direction is effectively prevented after the process of temporarily assembling tube unit 201.

Figure 20:
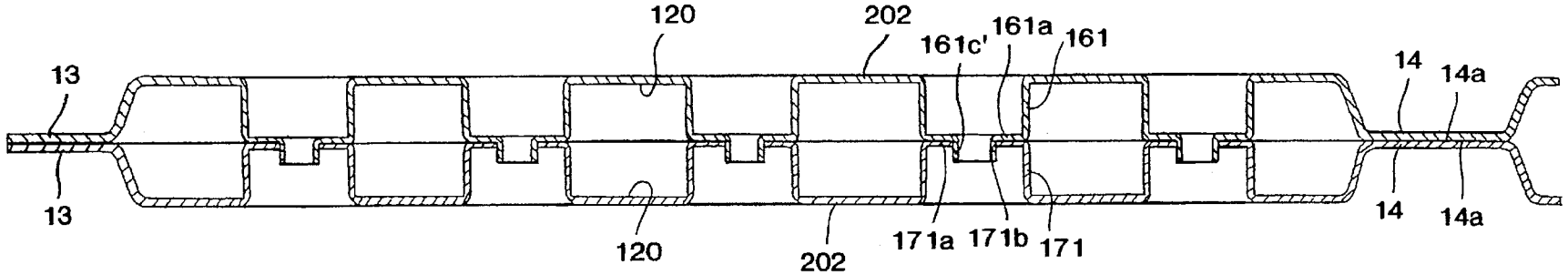
FIG. 20 is a view similar to FIG. 10 showing an eighth preferred embodiment.

FIG. 20 illustrates the eighth preferred embodiment. In this embodiment, an axial length of annular cylindrical projection 161*c*' is greater than that of annular cylindrical projection 161*c* of the seventh embodiment. According to this embodiment, annular cylindrical projection 161*c*' is more sufficiently received in circular opening 171*b* of bulged portion 171 so that the relative sliding movement of the pair of plates 202 in the radial direction is more effectively prevented after the process of temporarily assembling tube unit 201.

Figure 21:
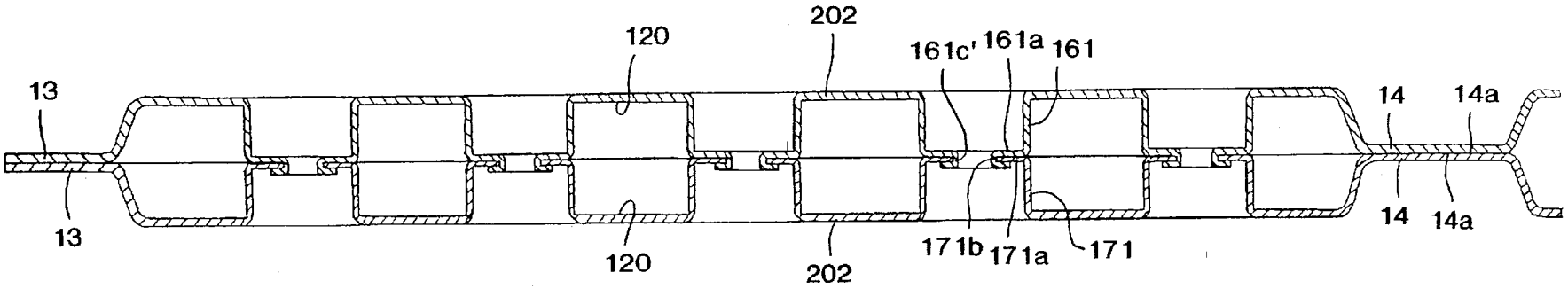
FIG. 21 is a view similar to FIG. 10 showing a ninth preferred embodiment.

FIG. 21 illustrates the ninth preferred embodiment. In this embodiment, a terminal end portion of annular cylindrical projection 161*c*' of the eighth embodiment is bent outwardly to be firmly engaged with an inner peripheral portion of circular opening 171*b* of bulged portion 171. Accordingly, the relative sliding movement of the pair of plates 202 in the radial direction is more effectively prevented after the process of temporarily assembling tube unit 201.

Figure 22:
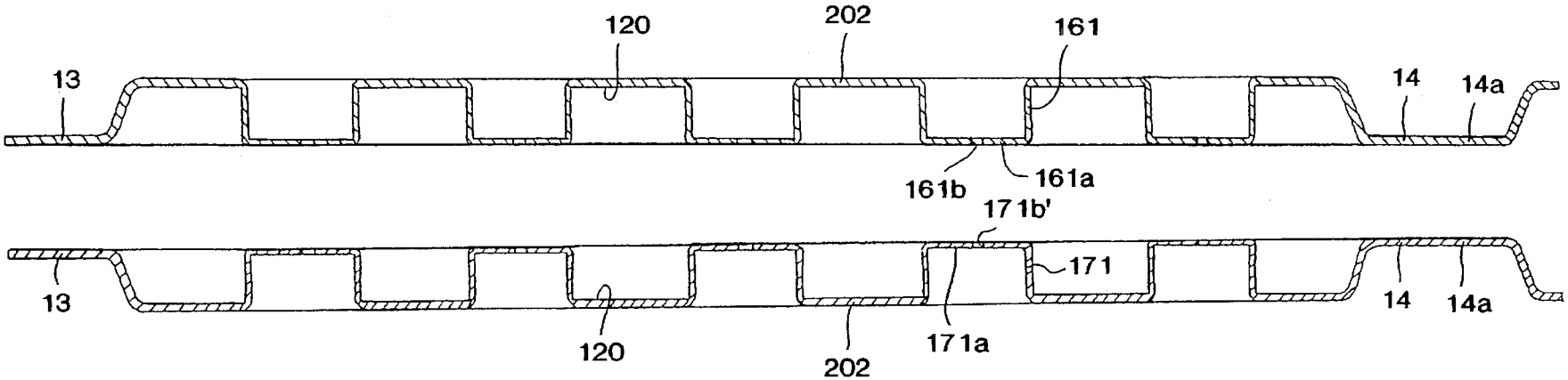
FIGS. 22–24 are views illustrating when a pair of plates of a tube unit in accordance with a tenth preferred embodiment are joined to each other.
Figure 23:
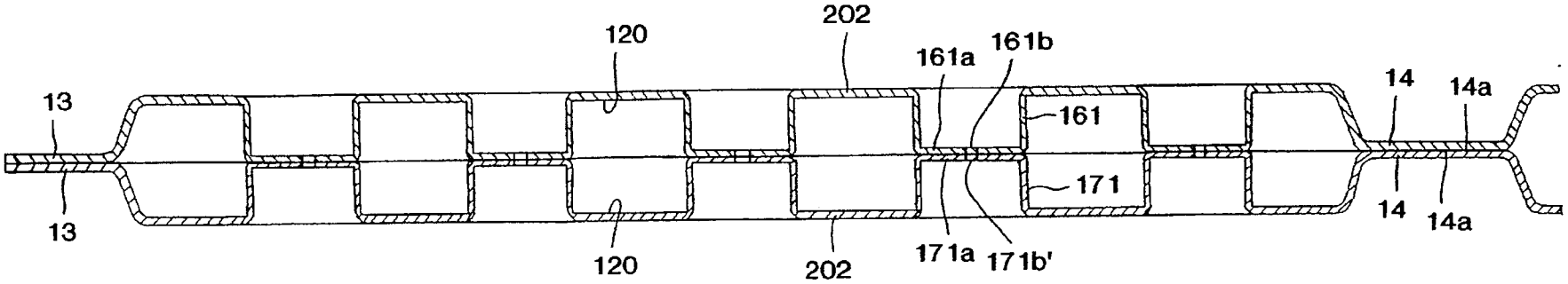
Figure 24:
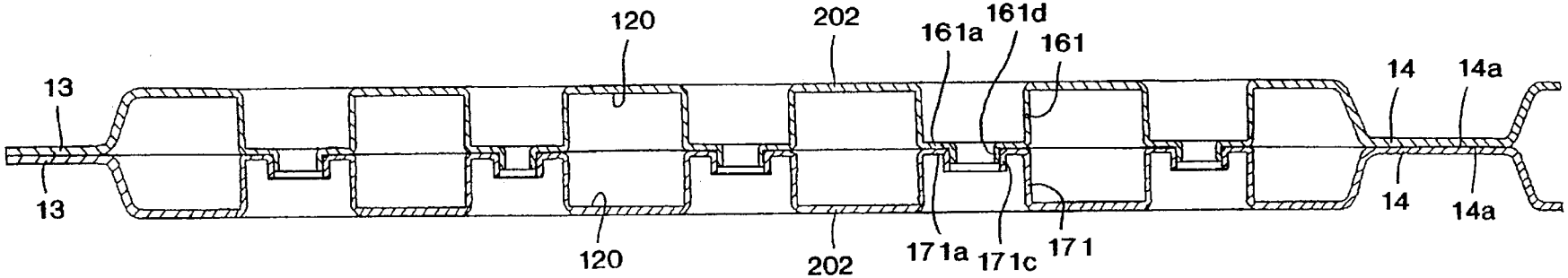

FIGS. 22–24 illustrate the tenth preferred embodiment. As shown in FIGS. 22, a diameter of circular opening 171*b*' of bulged portion 171 is generally equal to that of circular opening 161*b* of bulged portion 161. As shown in FIG. 23, when the pair of plates 202 are temporarily joined each other, bulged portions 161 and 171 contact one another at the upper surfaces of their flat bottom end sections 161*a* and 171*a*, flanges 13 contact one another at their planes, tongues 203 (shown in FIG. 6) contact one another at their flat top end surfaces, and narrow walls 14 contact one another at their flat top surfaces 14*a*. Then, as shown in FIG. 24, an inner peripheral portion of circular opening 161*b* of each bulged portion 161 is bent downwardly by bending an inner peripheral portion of circular opening 171*b*' of each bulged portion 171, thereby forming annular cylindrical projections 161*d* and 171*c* with an outer peripheral surface of annular cylindrical projection 161*d* engaged with an inner peripheral surface of annular cylindrical projection 171*c*. Accordingly, in this embodiment, the relative sliding movement of the pair of plates 202 in the radial direction is more effectively prevented after the process of temporarily assembling tube unit 201.

Figure 25:
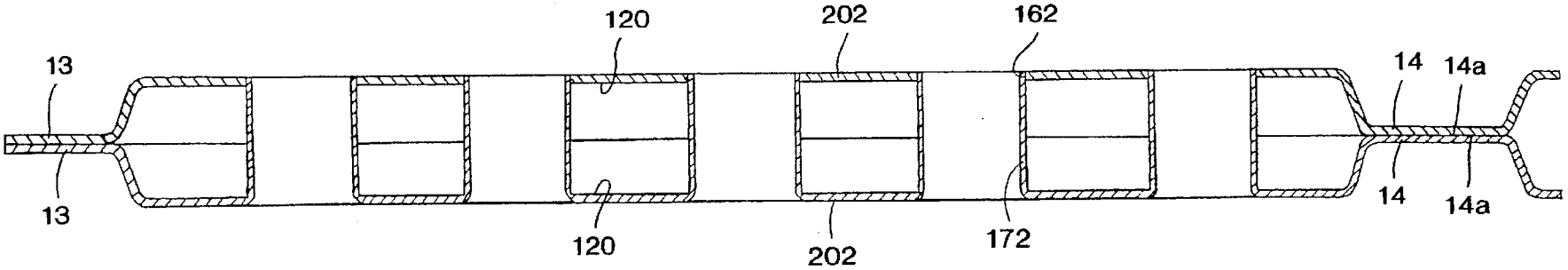
FIG. 25 is a view similar to FIG. 10 showing an eleventh preferred embodiment.

With reference to FIG. 25 illustrating the eleventh preferred embodiment, a plurality of circular openings 162 are formed at the inner bottom surface of shallow depression 120. A plurality of annular cylindrical projections 172 are formed at the inner bottom surface of opposing shallow depression 120 to correspond to circular openings 162 when the pair of plates 202 are joined each other. The diameter of circular opening 162 is slightly greater than the outer diameter of annular cylindrical projection 172. The axial length of annular cylindrical projection 172 is approximately twice the depth of shallow depression 120. Thus, a terminal end portion of annular cylindrical projections 172 is snugly received in the corresponding circular openings 162 and the terminal and surface of annular cylindrical projection 172 is substantially even with the outer bottom surface of shallow depression 120 when the pair of plates 202 are joined to each other.

Figure 26:
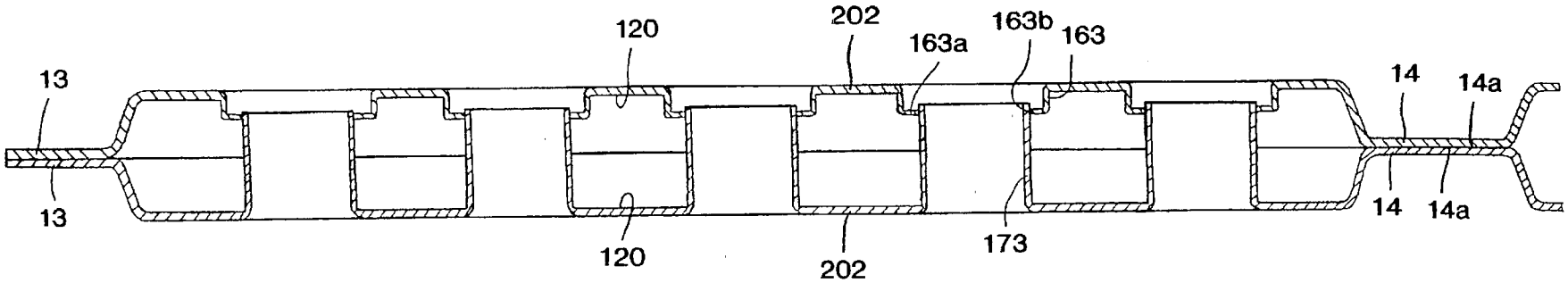
FIG. 26 is a view similar to FIG. 10 showing a twelfth preferred embodiment.

With reference to FIG. 26 illustrating the twelfth preferred embodiment, a plurality of cylindrical bulged portions 163 are formed at the inner bottom surface of shallow depression 120. A plurality of annular cylindrical projections 173 are formed at the inner bottom surface of opposing shallow depression 120 to correspond to cylindrical bulged portions 163 when the pair of plates 202 are joined to each other. Circular opening 163*b* is formed at a central region of a flat bottom end section 163*a* of each of bulged portions 163. The diameter of circular opening 163*b* is slightly greater then the outer diameter of annular cylindrical projection 173. The axial length of cylindrical bulged portion 163 is approximately one third of the depth of shallow depression 120. The axial length of cylindrical projection 173 is approximately five thirds of the depth of shallow depression 120. Thus, a terminal end portion of annular cylindrical projections 173 is snugly received in the corresponding circular openings 163 and the terminal end surface of annular cylindrical projection 173 slightly extends over an outer surface of the flat bottom end section 163*a* of bulged portion 163 when the pair of plates 202 are joined to each other.

The arrangement of the engagements disclosed in the eighth through twelfth embodiments can be freely selected. For example, as shown in FIGS. 11–13, the engagements may be placed such that the different sized projections are arranged in alternating rows, alternating columns, offset from one another in diagonal rows or any combination of the above.

Figure 27:
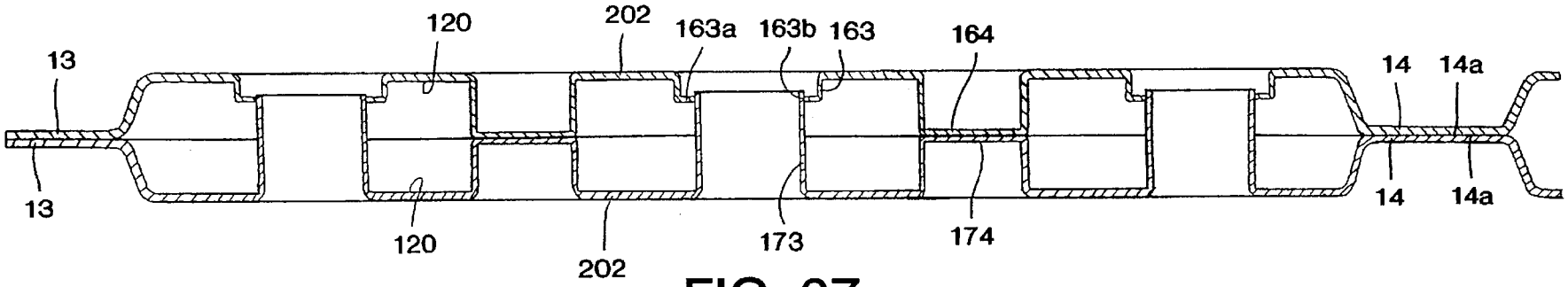
FIG. 27 is a view similar to FIG. 10 showing a thirteenth preferred embodiment.

FIG. 27 illustrates the thirteenth preferred embodiment, which incorporates features of the embodiments depicted in FIGS. 18 and 26. In this embodiment, the contact of annular cylindrical projections 164 and 174 is similar to the configuration shown in FIG. 18. In addition, the engagement of annular cylindrical projections 163 and 173 is similar to the configuration shown in FIG. 26, but arranged alternately in each row.

With reference to FIGS. 28–31 illustrating the fourteenth preferred embodiment, an evaporator 200" includes a plurality of aluminum alloy tube units 11 functioning as the heat medium conducting elements, which form a heat exchanging area 200*a* of evaporator 200" together with corrugated fins 20. Each of tube units 11 comprises a pair of tray-shaped plates 12 having a clad construction where a brazing metal sheet is disposed on a core metal. Tray-shaped plates 12 include a shallow depression 120 defined therein, a flange 13 formed around the periphery thereof, and a narrow wall 14 formed in the central region thereof. Narrow wall 14 extends downwardly from an upper end of plate 12 and terminates approximately one-eighth the length of plate 12 away from the lower end thereof. Narrow wall 14 includes a flat top surface 14*a*. A plurality of, e.g., six, rectangular-shaped openings 14*b* are formed at the flat top surface 14*a* of narrow wall 14 along the entire length of narrow wall 14.

A pair of truncated quadrangular pyramid bulged portions 41 are formed in the upper region of plate 12 such that a hollow space 41*b* is defined by each bulged portion 41. An oval opening 41*a* is formed in the bottom surface of each bulged portion 41. A plurality of, e.g., three, truncated quadrangular pyramid projections 42 project from the inner bottom surface of shallow depression 120 adjacent to the interior surface of each bulged portion 41. Each of the three projections 42 includes a flat top surface 42*a*. Rectangular-shaped opening 42*b* is formed at the flat top surface 42*a* of each projection 42 so that the flux on the exterior surface of projections 42 seeps into the gaps created between the mating surface of projections 42 through rectangular-shaped openings 42*b*. A rectangular flange 18 projects from the lower end of plate 12, and is bent downwardly in a generally right angle at the terminal end thereof.

The plane of flat top surface 14*a* of narrow wall 14 and the plane of the flat top surface 42*a* of projections 42 are even with the plane of flange 13. Therefore, when the pair of tray-shaped plates 12 are joined together by flanges 13 so as to form a U-shaped passage 205 therebetween, narrow walls 14 of each plate 12 contact one another at their flat top surfaces 14*a*, and projections 42 of each plate 12 contact one another at their flat top surfaces 42*a*.

Evaporator 200" is formed by laminating together a plurality of tube units 11 and inserting corrugated fins 20 within the intervening spaces 21 between the adjacent tube units 11. Tube unit 11, located on the far left side of evaporator 200" shown in FIG. 28, includes a tray-shaped plate 12*a* having no bulged portion 41. Plate 12*a* is provided with a cylindroid-shaped tank 43 which is fixedly attached to the upper end thereof. The interior region of tank 43 is linked to hollow space 41*b* in the adjacent front side bulged portion 41 of plate 12 through an opening (not shown) formed in the upper end of plate 12*a*. Tube unit 11, located on the far right side of evaporator 200", also includes a tray-shaped plate 12*b* having no bulged portion 41. Plate 12*b* is provided with a cylindroid-shaped tank 44 which is fixedly attached to the upper end thereof. The interior region of tank 44 is similarly linked to hollow space 41*b* in the adjacent front side bulged portion 41 of plate 12 through an opening (not shown) formed in the upper end of plate 12*b*.

Tank 43 is provided with a circular opening 43*a* formed in the front surface thereof. Tank 44 is provided with a circular opening 44*a* also formed in the front surface thereof. One end of an inlet pipe 50 is connected to opening 43*a* of tank 43 and one end of an outlet pipe 60 is connected to opening 44*a* of tank 44. Inlet pipe 50 is provided with a union joint 50*a* at the other end thereof and outlet pipe 60 is similarly provided with an union joint 60*a* at the other end thereof.

A pair of side plates 22 are attached to the left side of plate 12*a* and to the right side of plate 12*b*, respectively, and corrugated fins 20 are disposed between side plate 22 and plate 12*a*, and between side plate 22 and plate 12*b*, respectively. The lower end of side plates 22 includes a rectangular flange 22*a* projecting inwardly and then bent downwardly in a generally right angle at the terminal end thereof. Respective tube units 11, corrugated fins 20, and side plates 22 are fixedly attached to one another by any conventional manner, such as brazing, for example.

Figure 28:
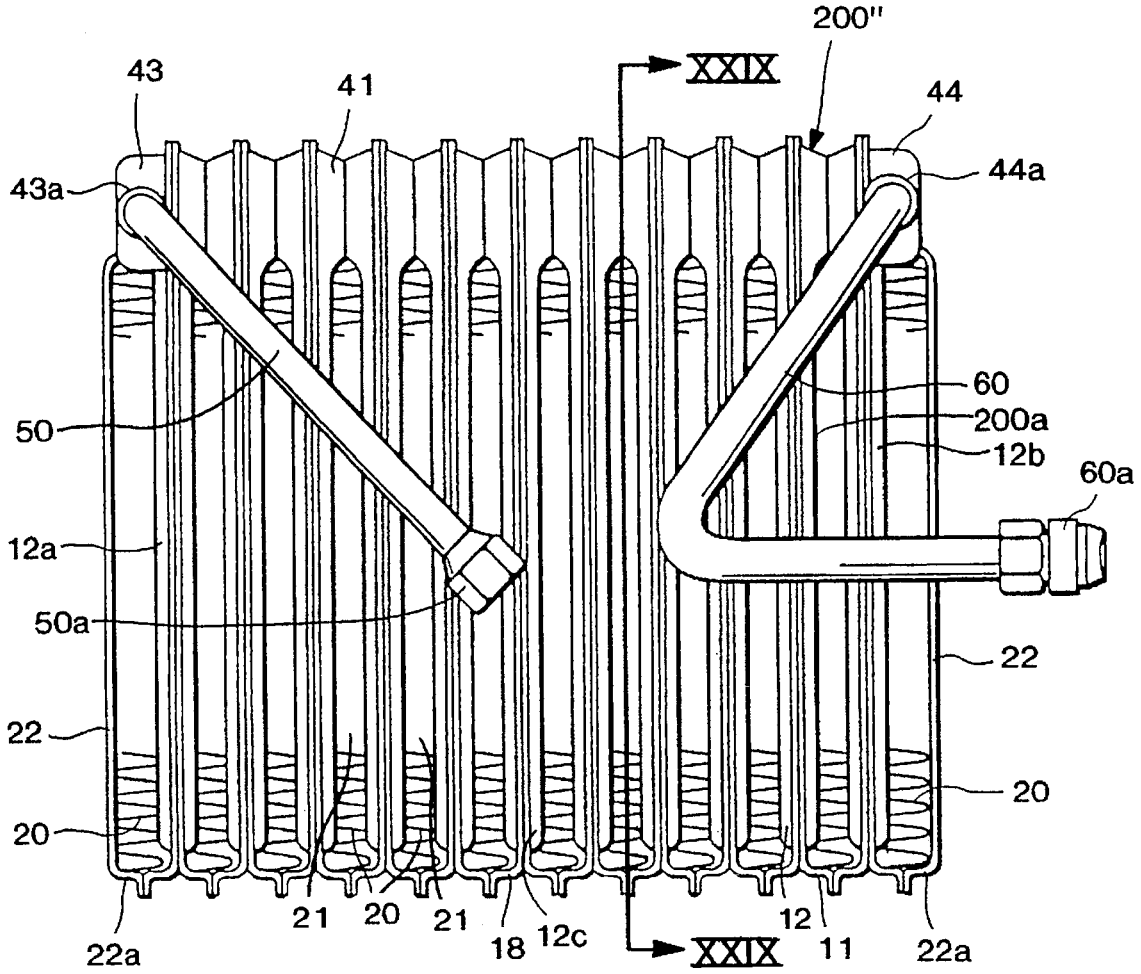
FIG. 28 is an elevational front view of another style of a laminated type evaporator in accordance with a fourteenth preferred embodiment.
Figure 29:
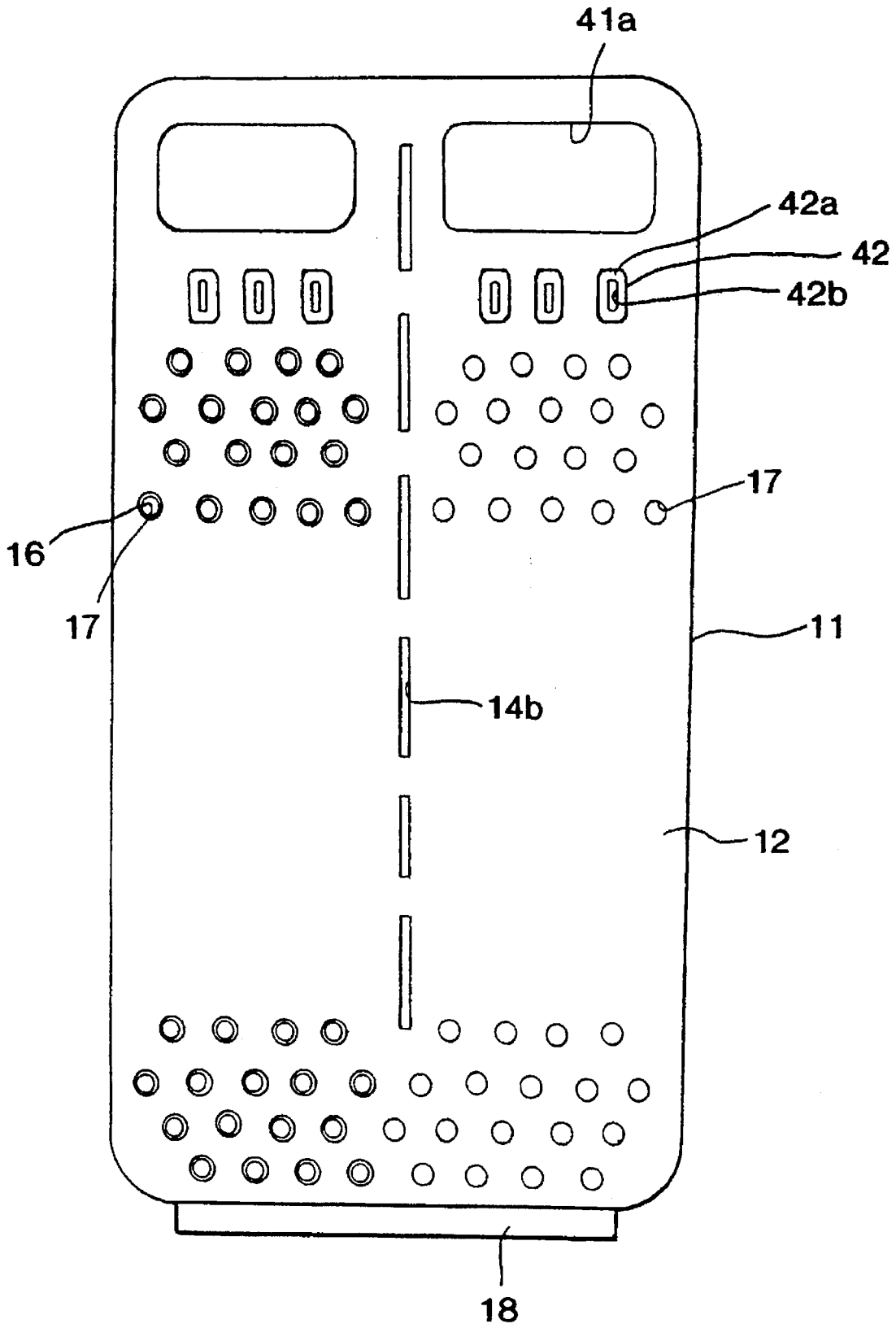
FIG. 29 is an end view of an assembled tube unit taken on line XXIX—XXIX of FIG. 28.
Figure 30B:
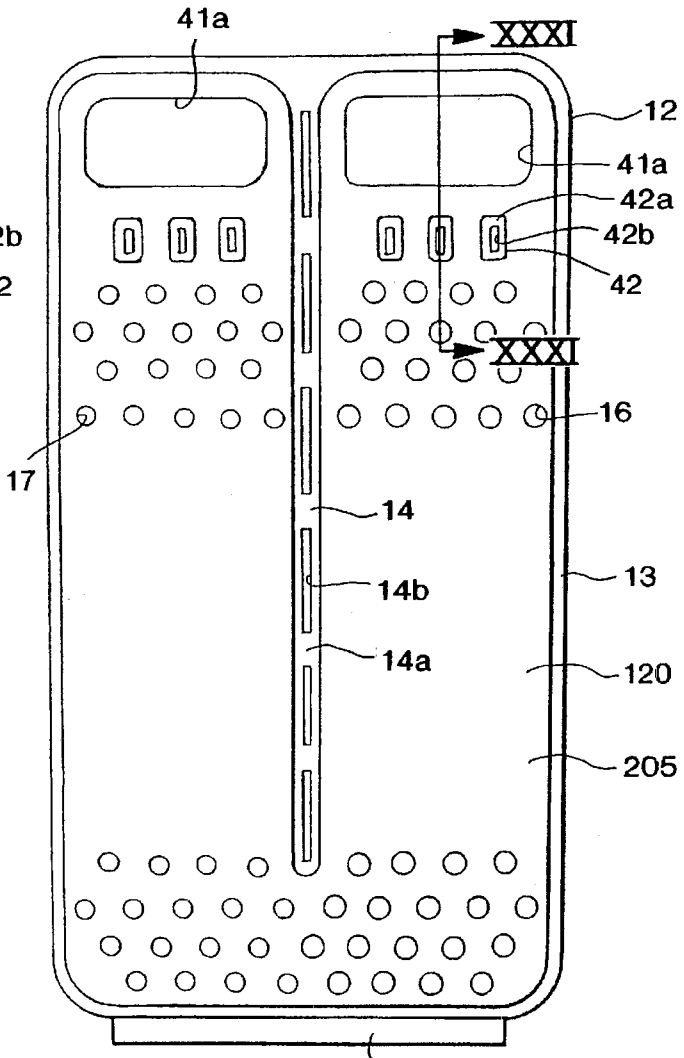
FIG. 30 shows the tube unit in FIG. 29 unassembled.
Figure 30A:
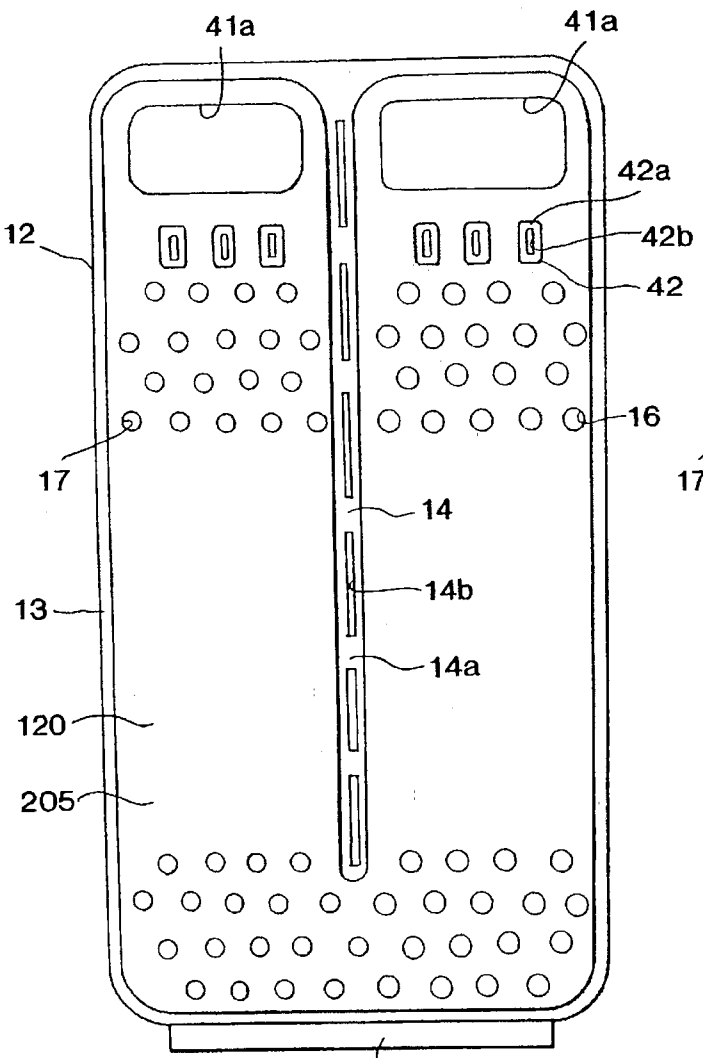
Figure 31:
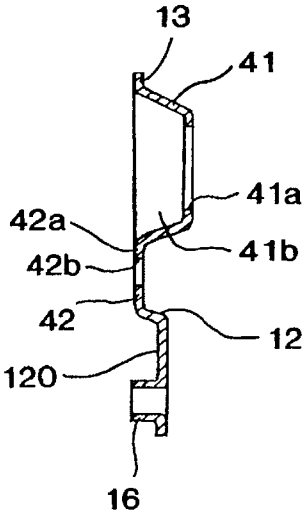
FIG. 31 is a view taken on line XXXI—XXXI of FIG. 30.

Although corrugated fins 20 are only illustrated in FIG. 28 at the upper and lower ends of intervening spaces 21, it should be understood that corrugated fins 20 continuously extends along the entire length of intervening spaces 21.

In addition, although tray-shaped plate 12*c* located in this central region of evaporator 200" includes a pair of bulged portions 41, it should be noted that bulged portion 41 located on the front side of the evaporator does not have an oval opening 41*a*. Latitudinal adjacent hollow spaces 41*b* of the pair of bulged portions 41 are linked to one another through oval openings 41*a*, thereby forming a pair of parallel conduits. One conduit is located on the front side of evaporator 200" and the other is located on the rear side of evaporator 200". One conduit located on the front side of evaporator 200" is divided into left and right side sections by the front side bulged portion 41 of plate 12*c*.

A plurality of annular cylindrical projections 16 and 17 project from the inner bottom surface of shallow depression 120. Annular cylindrical projections 16 and 17 are formed by, for example, burring. The dimensions and arrangement of annular cylindrical projections 16 and 17 are similar to those of the first preferred embodiment. Of course, in this embodiment, any type of the arrangement of annular cylindrical projections 16 and 17, such as shown in FIGS. 11–13, can be provided. The engagement of annular cylindrical projections 16 and 17 is also similar to that of the first preferred embodiment. Of course, in this embodiment, any type of the engagement, such as shown in FIGS. 17–27 can be provided.

Figure 32:
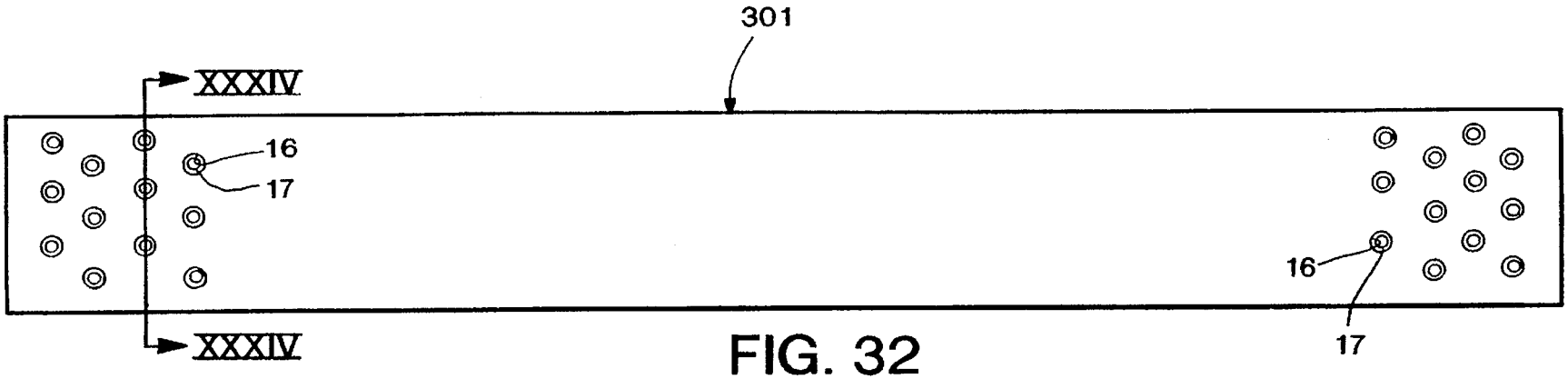
FIG. 32 is a plan view of a flat tube constituting a heat exchanger in accordance with a fifteenth preferred embodiment.
Figure 33A:
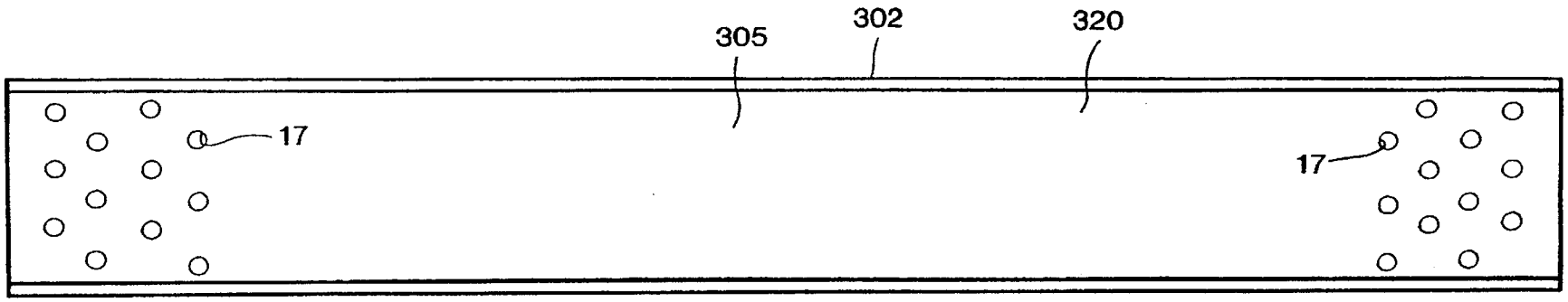
FIG. 33 shows the flat tube in FIG. 32 unassembled.
Figure 33B:
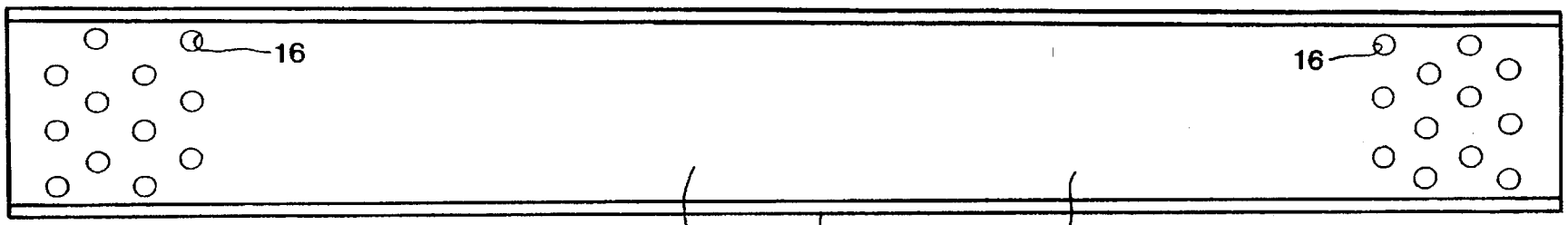
Figure 34:
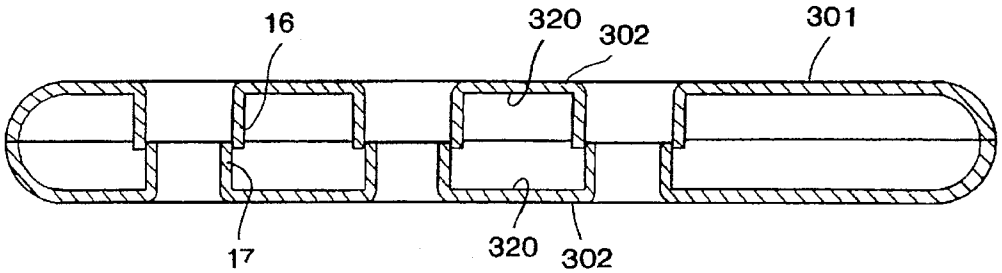
FIG. 34 is a view taken on line XXXIV—XXXIV of FIG. 32.

FIGS. 32–34 illustrates the fifteenth preferred embodiment. In this embodiment, the engagement of annular cylindrical projections 16 and 17 disclosed in the first embodiment is applied to the flat tubes of the condenser discussed in U.S. Pat. No. 5,101,887 to Kado.

With reference to FIGS. 32–34, flat tube 301 comprises a pair of semicylindroidal plates 302 which include a shallow depression 320 defined therein. A plurality of annular cylindrical projections 16 project from the inner bottom surface of shallow depression 320 of one of the pair of plates 302. A plurality of annular cylindrical projections 17 project from the inner bottom surface of shallow depression 320 of the other of the pair of plates 302. Annular cylindrical projections 16 and 17 are located on the inner bottom surface of the corresponding shallow depressions 320, respectively, and are engaged with one another when the pair of plates 302 are joined to each other.

According to this embodiment, the refrigerant fluid flows through passageway 305 defined in tube units 301 in a complex flow path, which includes diagonal and straight flow path so that a heat exchange efficiency of the condenser is more effectively enhanced than that of the condenser of the above '887 patent.

Figure 35:
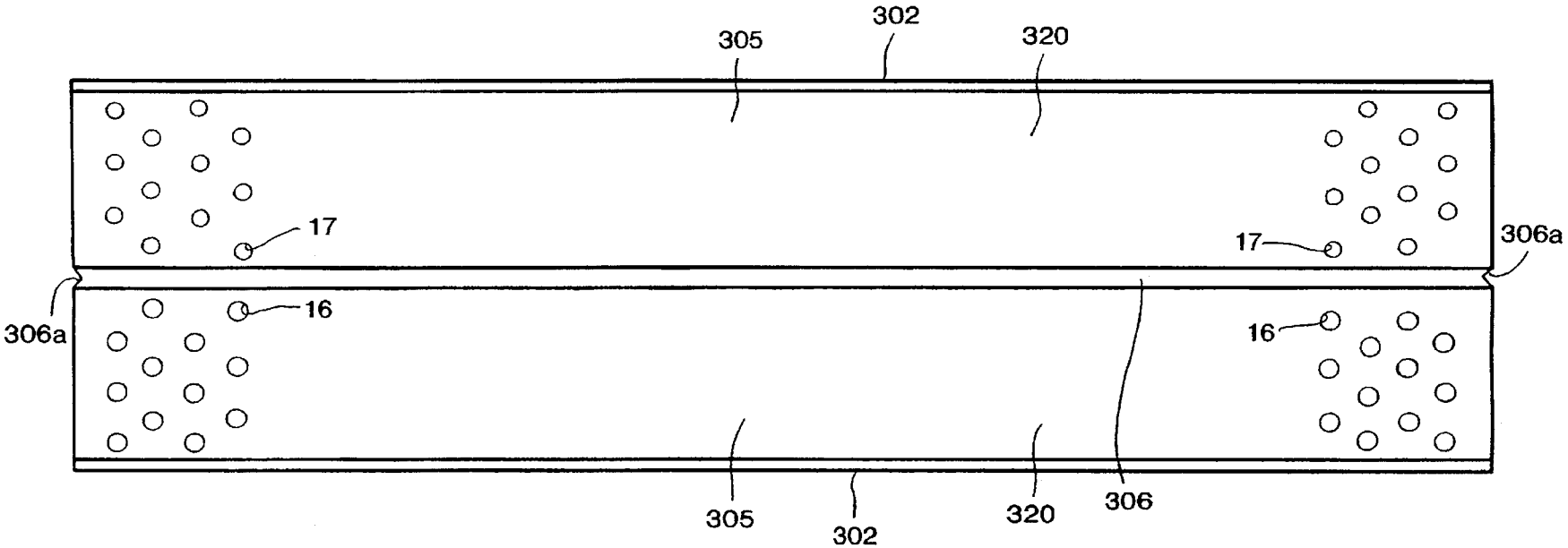
FIG. 35 is a view similar to FIG. 33 showing a sixteenth preferred embodiment.

FIG. 35 illustrates the sixteenth preferred embodiment. In this embodiment, the pair of semicylindroidal plates 302 are formed integrally through a long and narrow planar portion 306 which continually extends from the adjacent side ends of plates 302. The surface of planar portion 306 is even with the plane of the side ends of plates 302. A pair of triangular cut out portions 306*a* are formed at both axial ends of planar portion 306, respectively, so that planar portion 306 is easily folded. The pair of plates 302 are joined to each other by folding planar portion 306. According to this embodiment, since the pair of plates 302 are joined by folding planer portion 306, the relative sliding movement of the pair of plates 302 in the radial direction is effectively prevented after the process of temporarily assembling tube unit 301.

In the fifteenth and sixteenth embodiments, although annular cylindrical projections 16 and 17 are only illustrated in both end regions of shallow depression 320 in FIGS. 33 and 35, it should be understood that annular cylindrical projections 16 and 17 continually extend along the entire length of shallow depression 320. Furthermore, as shown in FIGS. 33 and 35, annular cylindrical projections 16 and 17 are arranged in the plates 302 in a manner similar to that of the first embodiment. However, the arrangement of annular cylindrical projections 16 and 17 in the plates 302 is not restricted thereto, but any type of arrangement of annular cylindrical projections 16 and 17 in the plates 302, such as shown in FIGS. 11–13, can be provided. In addition, any type of the engagement of annular cylindrical projections 16 and 17, such as shown in FIGS. 17–27, can be provided.

This invention has been described in detail in connection with the preferred embodiments. These embodiments, however, are merely for example only and the invention is not restricted thereto. It will be understood by those skilled in the art that other variations and modifications can easily be made within the scope of this invention, as defined by the appended claims.

What is claimed is:

1. A heat exchanger comprising:

a plurality of laminated tube units, each of said tube units including a pair of plates joined together to define therebetween a fluid passageway and at least one fluid communication opening extending from said pair of plates and linked in fluid communication with said fluid passageway;

at least one conduit disposed on an upper surface of said plurality of laminated tube units, said at least one conduit including a plurality of slots for receiving said at least one fluid communication opening in said plurality of laminated tube units;

each plate in said pair of plates including a shallow depression formed therein, a flange extending about the periphery thereof, and a wall disposed at an intermediate location therein and extending a portion of the length of each of said plate, said wall thereby defining a first side and a second side in said plates; and a plurality of engaging means formed in at least some of said first and second plates for securing at least some of said first and second plates, said engaging means comprising:

a plurality of first projections formed in said shallow depression of said first plate, said first projections comprising a plurality of cylindrical bulged portions formed in said shallow depression and circular openings comprising through-holes formed at a central region of each of said bulged portions; and a plurality of second projections formed in said shallow depression of said second plate, said second projections comprising a plurality of cylindrical bulged portions formed in said shallow depression and circular openings comprising through-holes formed at a central region of each of said bulged portions;

wherein said first and second projections, before brazing, are operatively engaged by bending outwardly at least some of said first projections to overlap corresponding said second projections so that said first and second plates are secured from movement in substantially all directions.

2. The heat exchanger of claim 1, said first and second plates each having a plurality of first annular cylindrical projections on the first side of said wall and a plurality of second annular cylindrical projections on the second side of said wall.

3. The heat exchanger of claim 1, said first and second plates having a plurality of first and a plurality of second annular cylindrical projections on the first said of said wall and a plurality of first and a plurality of second annular cylindrical projections on the second side of said wall.

4. The heat exchanger of claim 3, sail plurality of first and second annular cylindrical projections arranged in a plurality of diagonal rows such that each horizontal row is offset from adjacent horizontal rows.

5. The heat exchanger of claim 3, said first and second annular cylindrical projections aligned in a plurality of alternating vertical columns on said first side and said second side of the said wall.

6. The heat exchanger of claim 3, said first and second annular cylindrical projections aligned in a plurality of alternating horizontal rows on said first side and said second side of said wall.

7. The heat exchanger of claim 1, said first and second plates attached along a narrow planar portion formed between adjacent flanges.

8. The heat exchanger of claim 1, said walls in said first and second plates having a plurality of openings formed therethrough.

* * * * *